United States Patent [19]

Bahnsen

[11] 3,946,961

[45] Mar. 30, 1976

[54] AUTOMATIC TOWEL WINDING MACHINE

[75] Inventor: Erwin B. Bahnsen, Oakbrook, Ill.

[73] Assignee: Steiner American Corporation, Salt Lake City, Utah

[22] Filed: Aug. 15, 1974

[21] Appl. No.: 497,555

Related U.S. Application Data

[60] Continuation of Ser. No. 299,341, Oct. 20, 1972, abandoned, which is a division of Ser. No. 22,447, March 25, 1970, Pat. No. 3,761,032.

[52] U.S. Cl. ..... 242/67.1 R

[51] Int. Cl.[2] ..... B65H 17/00

[58] Field of Search ..... 242/67.1, 81, 57.1, 207, 242/75.5, 75.51

[56] References Cited

UNITED STATES PATENTS

| | | | |
|---|---|---|---|
| 1,977,668 | 10/1934 | Dallas | 242/81 X |
| 2,529,075 | 11/1950 | Dawson | 242/207 |
| 2,568,790 | 9/1951 | Collins | 242/207 |
| 2,760,734 | 8/1956 | Hornberger | 242/75.5 |
| 2,826,376 | 11/1958 | Wallin | 242/81 |
| 2,968,449 | 1/1961 | Hajos | 242/57.1 |
| 3,222,006 | 12/1965 | Bahnsen | 242/67.1 |
| 3,246,857 | 4/1966 | Morse | 242/75.5 X |

*Primary Examiner*—Leonard D. Christian
*Attorney, Agent, or Firm*—Prangley, Dithmar, Vogel, Sandler & Stotland

[57] ABSTRACT

An automatic towel winder includes a frame supporting a plurality of winding units and a conveyor assembly for feeding a plurality of towels respectively to the winding units along a plurality of parallel side-by-side lanes, each of the winding units occupying three adjacent lanes and including a hollow winding mandrel having side perforations therein for winding the towel into a roll thereon, a constant-torque electric motor to drive the mandrel, suction means coupled to the hollow mandrel for urging the leading end of the fed towel against the mandrel to initiate winding thereon, an ejector for removing the wound towel roll from the mandrel and a receptacle for catching the ejected roll, the winding units being staggered on the frame to occupy a space only slightly wider than the combined widths of the fed towels; electric control circuitry for the winder and alternative embodiments of mandrel drive means and roll ejector are also disclosed.

2 Claims, 23 Drawing Figures

106
106a
150E
50
151
152
141
108
154
140
135
146a
160
150F
185
149
177
152
143
151
55
179
183
146
177a
142
140
144
154
160
185
146a
150G
144
177
151
179
152
177a
183
145
160
185
154
147
179
177
177a
183
148

FIG. 15
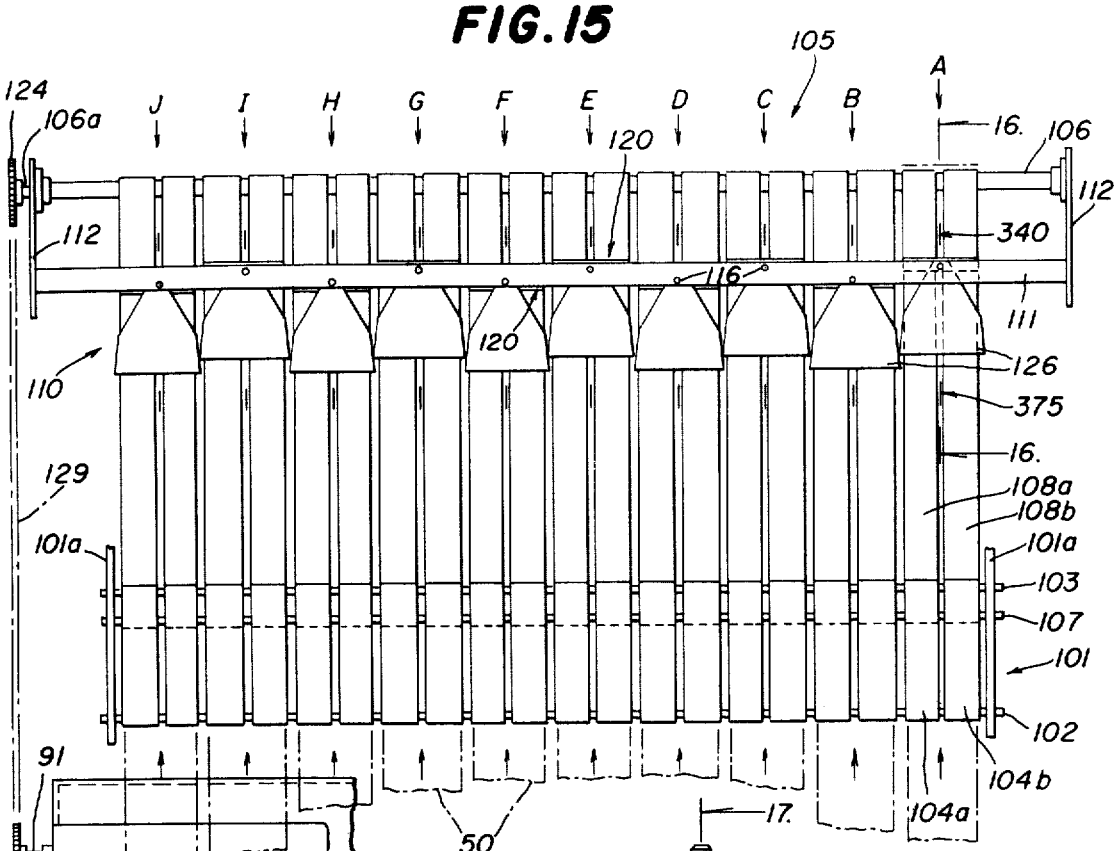
FIG. 16
FIG. 17
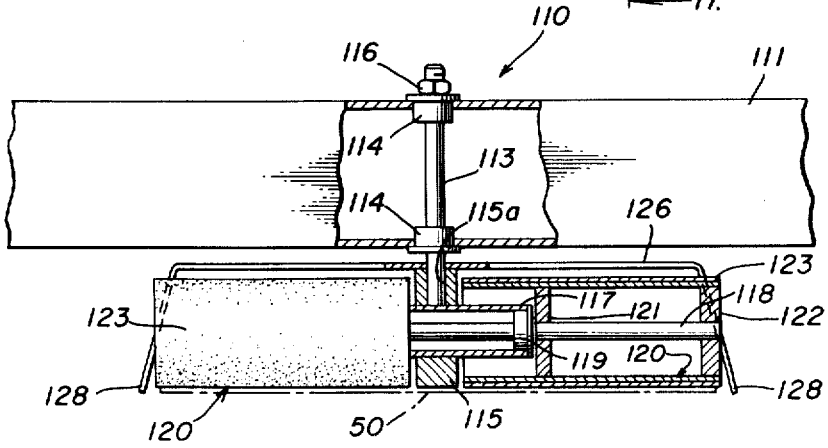

AUTOMATIC TOWEL WINDING MACHINE

This is a continuation of application Ser. No. 299,341, filed Oct. 20, 1972, now abandoned, which was a division of application Ser. No. 22,447, filed Mar. 25, 1970, now U.S. Pat. No. 3,761,032.

This invention relates to a machine for winding continuous toweling, and particularly, to a power-driven production machine which winds continuous toweling in rolls for use in towel cabinets and the like.

More particularly, this invention relates to a completely automatic machine capable of winding a plurality of continuous towels into towel rolls.

It is an important object of this invention to provide an automatic elongated towel winder comprising a support frame, a mandrel mounted on the frame and rotatable about the longitudinal axis thereof for winding an associated elongated towel into a roll thereon, drive means carried by the frame and coupled to the mandrel for effecting rotation thereof, feed apparatus mounted adjacent to the mandrel for feeding an elongated towel to the mandrel, and capture means for urging the leading end of the towel against the rotating mandrel for automatically initiating the winding of the towel into a towel roll on the mandrel, whereby an elongated towel may be automatically fed to the rotating mandrel and wound in a roll thereon.

Another object of this invention is to provide a towel winder of the type set forth wherein the mandrel has a supported end mounted on the frame and a free distal end, and further including an ejector carried by the frame for removing the wound towel roll from the mandrel at the free end thereof.

Another object of this invention is to provide a towel winder of the type set forth wherein the mandrel is hollow and has an opening in the side thereof, and wherein the capture means includes a suction pump coupled to the mandrel for causing an area of reduced pressure therein and a consequent flow of air toward and through the opening which serves to move the leading end of the towel fed from the feed apparatus toward and against the rotating mandrel for automatically initiating the winding of the towel into a towel roll on the mandrel.

Still another object of this invention is to provide a towel winder of the type set forth wherein the feed apparatus is disposed adjacent to and above the mandrel for feeding the towel downwardly to the side of the mandrel in the direction of rotation thereof, and further including a guide member carried by the frame on the side of the mandrel in the direction of rotation thereof and extending beneath the mandrel a short distance therefrom, for maintaining the leading end of the towel closely adjacent to the mandrel to facilitate the pickup of the leading end of the towel by the capture means.

It is another object of this invention to provide a towel winder of the type set forth wherein the drive means is of the constant-torque type for maintaining a substantially constant torque at the mandrel, the increasing circumference of the towel roll on the mandrel as the diameter of the towel roll increases serving to decrease the rotational speed of the mandrel to maintain a substantially constant tension in the portion of the towel extending between the mandrel and the feed apparatus.

It is another object of this invention to provide a towel winder of the type set forth wherein the ejector includes an ejector member carried by the frame adjacent to the mandrel and movable between a retracted position and an ejecting position, and a fluid-actuated piston connected member for moving the member to the ejecting position thereof for causing the member to engage the wound towel roll and remove the towel roll from the mandrel at the free end thereof and means for returning the ejector member to the retracted position thereof at a controlled slow rate.

Yet another object of this invention is to provide a towel winder set forth, and further including control apparatus coupled to the drive means and responsive to the passage of the leading end of the towel toward the mandrel for actuating the drive means.

It is another object of this invention to provide a towel winder of the type set forth, and further including control apparatus coupled to the capture means and responsive to the passage of the leading end of the towel toward the mandrel for actuating the capture means.

It is another object of this invention to provide a towel winder of the type set forth, and further including control apparatus coupled to the ejector and responsive to the passage of the trailing end of the towel from the feed apparatus for actuating the ejector to remove the wound towel roll from the mandrel.

It is still another object of this invention to provide a towel winder of the type set forth wherein the control apparatus is coupled to both the drive means and the capture means and is responsive to the passage of the leading end of the towel toward the mandrel for actuating both the drive means and the capture means.

It is another object of this invention to provide a towel winder of the type set forth, wherein the control apparatus is coupled to both the drive means and the ejector and is responsive to the passage of the leading end of the towel toward the mandrel for actuating the drive means, the control apparatus being responsive to the passage of the trailing end of the towel from the feed apparatus for actuating the ejector to remove the wound towel roll from the mandrel.

In connection with the foregoing object, it is another object of this invention to provide a towel winder of the type set forth wherein the control apparatus is responsive to the movement of the ejector to the ejecting condition thereof for actuating the drive means, the control apparatus being responsive to the passage of the leading end of the next towel toward the mandrel for moving the ejector to the retracted condition thereof.

It is another object of this invention to provide a towel winder of the type set forth, wherein the control apparatus is coupled to both the capture means and the ejector for actuating the capture means and the ejector in the manner set forth.

Another object of this invention is to provide a towel winder of the type set forth, wherein the control apparatus is coupled to the drive means and to the capture means and to the ejector for actuating the drive means and the capture means and the ejector in the manner set forth.

In connection with the foregoing object, it is still another object of this invention to provide a towel winder of the type set forth wherein the control apparatus is responsive to the movement of the ejector to the ejecting condition thereof for actuating the drive means, the control apparatus being responsive to the passage of the leading end of the next towel toward the mandrel for moving the ejector to the retracted condition thereof and for actuating the capture means, the control apparatus being responsive to the initiation of the winding of the towel on the mandrel for deactuating the capture means, the control apparatus being responsive to the passage of the trailing end of the towel from the feed apparatus for deactuating drive means and for moving the ejector to the ejecting condition thereof.

Another object of this invention is to provide a cloth flatwork feed-directing assembly comprising feed apparatus for feeding associated flatwork in a predetermined direction from the input end to and from the discharge end of the feed apparatus, means engaging the flatwork at spaced-apart points thereon for suspending a reach thereof between the input end and the discharge end, a sensing device mounted adjacent to the feed apparatus and sensing the suspended reach of flatwork for detecting deviation of the fed flatwork from the predetermined direction, and direction correcting means acting upon the suspended reach of flatwork and coupled to the sensing device and responsive to the detection thereby of deviation of the fed flatwork from the predetermined direction for redirecting the flatwork into the predetermined direction, whereby flatwork fed by the feed apparatus is continually maintained in the predetermined direction.

In conection with the foregoing object, it is another object of this invention to provide a feed-directing assembly of the type set forth, wherein the sensing device comprises a sensing member mounted adjacent to the feed apparatus for pivotal movement about a first axis angularly disposed with respect to the plane of the suspended reach of flatwork, the sensing member engaging the suspended reach of the fed flatwork and pivoting about the first axis in response to deviation of the fed flatwork from the predetermined direction, the direction correcting means including a guide roller frictionally engaging the suspended reach of the fed flatwork and being freely rotatable about a second axis disposed substantially normal to the first axis and coupled to the sensing member for pivotal movement about the first axis, pivotal movement of the sensing member in response to deviation of the fed flatwork from the predetermined direction causing pivotal movement of the guide roller for urging the flatwork back toward the predetermined direction.

It is another object of this invention to provide a towel winder of the type set forth which includes a feed-directing assembly of the type set forth.

In connection with the foregoing object, it is another object of this invention to provide a towel winder of the type set forth for use with an associated source of towels, the feed apparatus including an inclined feed conveyor having an input end disposed adjacent to and below the source of towels and an upper discharge end disposed adjacent to the mandrel, a towel from the source following a first feed path along the conveyor until the leading end of the towel is engaged by the mandrel, the initiation of the winding of the towel on the mandrel causing tension in the towel for thereby moving the towel to a second feed path wherein a reach of the towel is suspended between the source and the discharge end of the conveyor, the sensing device and the direction-correcting means acting upon the towel in the second feed path.

Still another object of this invention is to provide a towel winder of the type set forth, which further includes detectors disposed in the first and second feed paths for sensing the presence of a towel therein, the control apparatus being coupled to the detectors and responsive to the sensing thereby of towels in the first and second paths for controlling the operation of the drive means and the capture means and the ejector.

Another important object of this invention is to provide a towel winder for automatically winding a plurality of elongated towels, the winder comprising a support frame, feed apparatus for feeding a plurality of elongated towels respectively along a plurality of substantially parallel feed lanes including two outer feed lanes and at least one intermediate feed lane all arranged in side-by-side relationship, each of the feed lanes having a width only slightly greater than the width of the associated towel, a plurality of winding units carried by the frame and equal in number to the feed lanes, each of the winding units including a mandrel disposed in an associated one of the feed lanes transversely thereof and extending substantially thereacross, the mandrel being rotatable about the longitudinal axis thereof for winding an associated elongated towel into a roll thereon, drive means disposed adjacent to one side of the associated one feed lane and coupled to the mandrel for effecting rotation thereof, and capture means for urging the leading end of the towel against the rotating mandrel for automatically initiating winding of the towel into a towel roll on the mandrel, the drive means for one of the outer feed lanes and the intermediate feed lanes being respectively disposed in longitudinal alignment with adjacent feed lanes but displaced therefrom, the winding units being arranged on the frame so that each of the intermediate feed lanes and the other of the outer feed lanes includes the mandrel of the associated winding unit with the drive means of an adjacent winding unit displaced from the lane but in longitudinal alignment therewith, whereby a plurality of elongated towels may be respectively automatically fed to corresponding ones of the rotating mandrels and wound in rolls thereon in a space having a width only slightly greater than the combined widths of the towels.

In connection wih the foregoing object, it is another object of this invention to provide a towel winder of the type set forth, and further including control apparatus coupled to the drive means and the capture means in each of the winding units and responsive to the passage of the leading end of a towel in any of the feed lanes toward the associated mandrel for actuating the associated drive means and the associated capture means.

Another object of this invention is to provide a towel winder of the type set forth, wherein the winding units are staggered vertically and horizontally on the frame into upper and lower levels, and further including guide chutes respectfully disposed in the feed lanes associated with the lower level mandrels for respectively guiding the associated towels from the feed apparatus past the upper level drive means aligned with the associated feed lanes and to the lower level mandrels.

It is a further object of this invention to provide a towel winder of the type set forth, wherein each of the winding units includes an ejector for removing the wound towel roll from the mandrel at the free end thereof, and a towel receptacle disposed adjacent to the other side of the associated one feed lane for receiving the ejected towel roll from the mandrel, the winding units being arranged on the frame so that each of the intermediate feed lanes includes the mandrel of the associated winding unit with the drive means of one adjacent winding unit and the towel receptacle of another adjacent winding unit disposed in longitudinal alignment with the lane but displaced therefrom.

In connection with the foregoing object, it is another object of this invention to provide a towel winder of the type set forth, and further including control apparatus coupled to the drive means and to the capture means and to the ejector in each of the winding units and responsive to the passage of the leading end of a towel in any of the feed lanes toward the associated mandrel for actuating the associated drive means and the associated capture means, the control apparatus being responsive to the passage of the trailing end of the towel from the feed apparatus for actuating the corresponding ejector to remove the wound towel roll from the mandrel.

It is another object of this invention to provide a towel winder of the type set forth, wherein the winding units are staggered vertically and horizontally on the frame into upper and lower and intermediate levels, and further including first guide chutes for respectively guiding the associated towels to the intermediate level mandrels, and second guide chutes for respectively guiding the associated towels to the lower level mandrels.

Another object of this invention is to provide a towel winder of the type set forth wherein a single drive means is provided for driving all of the winding units, and further including first and second line shafts respectively disposed forwardly and rearwardly of the frame and rotatably driven by the drive means, the first line shaft being coupled to each of the upper mandrels for effecting rotation thereof, and the second line shaft being coupled to each of the intermediate and lower level mandrels for effecting rotation thereof.

In connection with the foregoing object, it is a still further object of this invention to provide a towel winder of the type set forth, which further includes control apparatus coupled to the drive means and to each of the winding units and responsive to the passage of the leading end of the towel in any of the feed lanes toward the associated mandrel for actuating the drive means and the associated capture means.

Further features of the invention pertain to the particular arrangement of the parts of the towel winder whereby the above-outlined and additional operating features are obtained.

The invention, both as to its organization and method of operation together with further objects and advantages thereof, will best be understood by reference to the following specification taken in conjunction with the accompanying drawings, in which:

FIG. 15 is a top plan view of the feed apparatus of the towel winding machine of the present invention;

FIG. 16 is an enlarged view in vertical section of the feed directing assembly for one of the feed lanes taken along the line 16—16 in FIG. 15;

FIG. 17 is a fragmentary view in partial section of the feed-directing assembly taken along the line 17—17 in FIG. 16;

While there have been described what are at present considered to be the preferred embodiments of the invention, it will be understood that various modifications may be made therein and it is intended to cover in the appended claims all such modifications as fall within the true spirit and scope of the invention.

Figure 1:
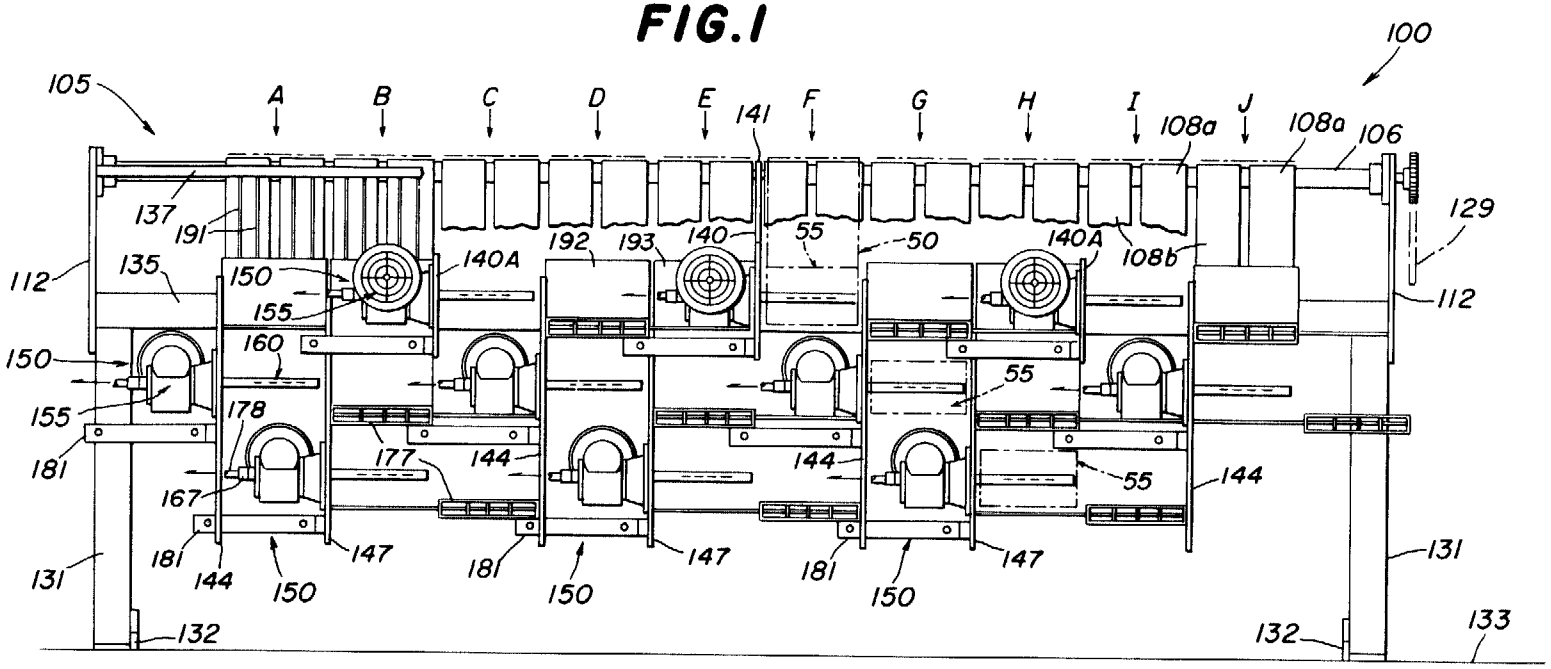
FIG. 1 is a front elevational view of an automatic towel winding machine according to this invention and showing ten winding units and the manner in which they are vertically staggered on the frame.
Figure 12:
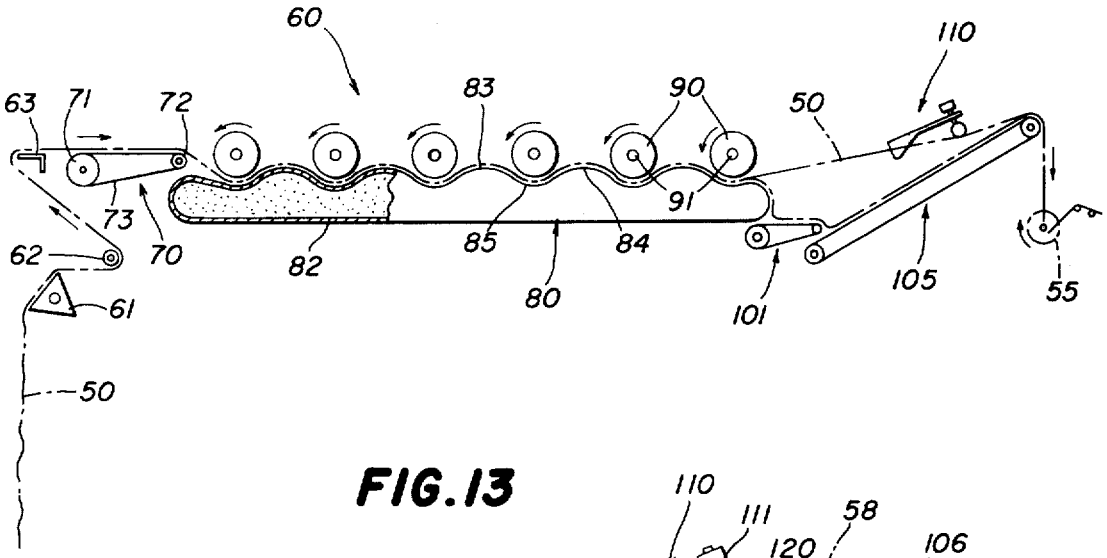
FIG. 12 is a reduced side elevational view in partial section of the towel ironer for use with the towel winding machine of this invention and illustrating the cooperation between the ironer and the feed apparatus of the present invention.

Referring now to the drawings, and in particular to FIGS. 1, 12 and 15 thereof, there is illustrated a towel winding machine, generally designated by the numeral 100, according to the present invention, the towel winding machine 100 including ten identical feed lanes, respectively designated A through J, inclusive, for respectively feeding associated elongated towels to ten winding units, each generally by the numeral 150, for winding the towels into rolls.

The towel winding machine 100 is adapted for use in a towel processing system which may perform several operations on the towel including washing, ironing, winding into rolls, and wrapping of the towel rolls. Such a system may, for example, include a towel washing machine of the type set forth in applicant's copending application Ser. No. 879,764, filed Nov. 25, 1969 now U.S. Pat. No. 3,698,214, and a towel roll wrapping machine of the type set forth in applicant's copending application Ser. No. 828,533, filed May 28, 1969 now U.S. Pat. No. 3,643,397, both of which copending applications have been assigned to the assignee of the present invention. The towel rolls processed by such a system are then preferably used in towel dispensers, which may be of the type set forth in the copending application Ser. No. 727,157 of Robert L. Steiner and Erwin B. Bahnsen, filed May 7, 1968 now U.S. Pat. No. 3,502,383, and assigned to the assignee of the present invention.

A towel ironer, generally designated by the number 60, for use with the winding machine 100 of the present invention, is illustrated in FIG. 12 of the drawings, the ironer 60 being adapted to receive a wet elongated towel web 50 from an associated washing mchine (not shown), to iron the towel web 50 and then to feed it to the associated winding machine 100 of the present invention for winding into a towel roll 55. The ironer 60 includes a beater 61 being substantially triangular in transverse cross section and being rotatable in a counterclockwise direction as viewed in FIG. 12, a guide bar 62 and a towel breaker member 63. The towel web 60 is threaded over the beater 61 and around the guide bar 62 and over the breaker 63 to a conveyor 70. The conveyor 70 is disposed substantially horizontally and includes a drive roll 71, an idler roll 72 and an endless conveyor belt 73 extending therebetween for conveying the towel web 50 from the breaker member 63 to a steam chest, generally designated by the numeral 80. The steam chest 80 is hollow and includes an encompassing wall 81 having a flat bottom 82 and a convoluted top 83 forming a plurality of alternating ridges 84 and valleys 85. A plurality of pinch rolls 90 are respectively disposed in the valleys 85 of the steam chest 80, each of the pinch rolls 90 being shaped and dimensioned complementary to the associated valley 85 of the steam chest 80 and being held therein under the controlled pressure of a spring-loading apparatus (not shown). Each of the rolls 90 is rotatable counterclockwise about a shaft 91 for moving the towel web 50 from left to right as viewed in FIG. 12. Thus, the towel web 50 is fed from the associated washing machine over the beater 61 and roll 62 and breaker 63 for removing folds and excess water from the towel web 50, and thence via the conveyor 70 to the steam chest 80. The towel web 50 is then fed between the pinch rolls 90 and the upper wall 83 of the steam chest 80 from left to right along the steam chest 80 and then is discharged from the right-hand end thereof. The action of the heat provided by the steam chest 80 and the compression provided between the rollers 90 and the steam chest 80 combine to iron the towel web 50 for removing wrinkles therefrom in a well-known manner.

The towel winding machine 100 includes a feed assembly comprising a transfer conveyor 101 and a feed conveyor 105, mounted on a supporting framework 101a. The transfer conveyor 101 is disposed substantially horizontally beneath the steam chest 80 and includes a drive roll 102 disposed immediately beneath the right-hand end of the steam chest 80, and an idler roll 103 disposed forwardly of the drive roll 102 and an endless conveyor belt 104 connecting the drive roll 102 to the idler roll 103. The transfer conveyor belt 104 moves in a clockwise direction as viewed in FIG. 13 and preferably has a surface speed approximately 40 percent greater than the surface speed of the towel web 50 as it is fed from the ironer 60, whereby the towel web 50 may be fed from the ironer 60 by the transfer conveyor 101 to the right as viewed in FIG. 13 without folding upon the transfer conveyor 101.

The feed conveyor 105 is substantially longer than the transfer conveyor 101 and is inclined at an acute angle to the horizontal. The feed conveyor 105 includes a drive roll 106 at the upper end thereof rotatably mounted on a shaft 106a which is preferably supported at the opposite ends thereof in bearings on end plates 112 which are supported on the frame 101a and on a winding unit frame 130 to be described. An idler roll 107 is disposed at the lower end of the feed conveyor 105 immediately below the idler roll 103 of the transfer conveyor 101. An endless conveyor belt 108 interconnects the drive roll 106 and the idler 107 and is driven thereby in a clockwise direction, as viewed in FIG. 13, for receiving the fed towel web 50 from the transfer conveyor 101 and feeding the towel web 50 upwardly along the feed conveyor 105 from the input end to the discharge end thereof. Thus, the transfer conveyor 101 and the feed conveyor 105 cooperate with the ironer 60 to define a lower feed path for the towel web 50 extending from the discharge end of the ironer 60, downwardly to the transfer conveyor 101 and forwardly therealong to the feed conveyor 105 and upwardly therealong to the discharge end thereof as is clearly indicated in FIG. 13. Hereinafter the end of winding machine 100 toward the discharge end of the feed conveyor 105 will be referred to as the forward end and the end toward the input end of the feed conveyor 105 will be referred to as the rearward end.

It is an important feature of the present invention that the transfer conveyor 101 and the feed conveyor 105 and the ironer 60 associated therewith are all of sufficient width to accommodate a plurality of towels respectively arranged thereon in a corresponding plurality of feed lanes, each of these feed lanes having a width only slightly greater than the width of the associated towel web 50 and being arranged substantially parallel to each other in side-by-side relationship. Referring to FIG. 15 of the drawings, it will be seen that ten such feed lanes, respectively designated by the letters A to J, inclusive, have been provided in the preferred embodiment of this invention, but it will of course be recognized that the machinery of this invention may be constructed so as to accommodate any desired number of such feed lanes. The transfer conveyor 101 and the feed conveyor 105 are each provided with ten pairs of endless conveyor belt halves, respectively centered in the ten feed lanes A to J. More particularly, in each of the feed lanes A to J, the transfer conveyor 101 is provided with a pair of substantially parallel spaced-apart endless conveyor belt halves 104*a* and 104*b*, respectively, disposed on opposite sides of the longitudinal midline of the associated feed lane, and cooperating to define the associated conveyor belt 104. Similarly, the feed conveyor 105 is provided in each feed lane thereof with a pair of substantially parallel spaced-apart endless conveyor belt halves 108*a* and 108*b*, respectively, disposed in longitudinally alignment with the corresponding pairs of conveyor belt halves 104*a* and 104*b*, and cooperating to define the conveyor belts 108.

Connected to one end of the shaft 91 of the discharge roll 90 of the ironer 60 is a sprocket 95. Similarly, connected to the adjacent end of the shaft 106*a* of the feed conveyor drive roll 106 is a sprocket 124, the sprockets 95 and 124 being interconnected by a drive connecting assembly 129, whereby the feed conveyor 105 is driven in the direction indicated at a speed having a predeterimined fixed relationship to the speed of the ironer 60.

For each of the feed lanes A to J, the feed conveyor 105 is also provided with two control switches, respectively generally designated by the numerals 340 and 375, and being disposed within the loop formed by the associated pair of conveyor belt halves 108*a* and 108*b*. The control switch 340 is disposed adjacent to the upper of discharge end of the feed conveyor 105 and is provided with a movable contact 342*a* in the form of a generally hook-shaped wire resiliently urged into a normally open position extending upwardly between the associated pair of conveyor belt halves 108*a* and 108*b* and into the first feed path of the towel web 50 along the feed conveyor 105. The control switch 375 is disposed rearwardly of the switch 340 and is also provided with a movable contact 376 in the form of a generally hook-shaped wire resiliently urged into a normally open position extending upwardly between the associated pair of conveyor belt halves 108*a* and 108*b* and into the first feed path of the towel web 50 along the conveyor 105. The purpose of the control switches 340 and 375 will be described more fully hereinafter.

Referring now to FIGS. 12 through 17 of the drawings, there is provided adjacent to the upper end of the feed conveyor 105, a bridging member 111 spanning the feed lanes the feed lanes A to J, and supported at the opposite ends thereof on the end plates 112 of the winding machine frame a short distance above the conveyor belts 108 by suitable means. The bridging member 111 is disposed rearwardly of the discharge end of the feed conveyor 105 between the switch contacts 342*a* and 376 and is preferably of tubular construction having a substantially rectangular cross section, the bridge member 111 being turned slightly on its longitudinal axis so that its lower surface is substantially parallel to the plane of the feed conveyor 105. Mounted on the bridge member 111 are ten identical feed-directing assemblies, each generally designated by the numeral 110, and respectively disposed in the feed lanes A to J. Each of the feed-directing assemblies 110 includes a pivot pin 113 disposed substantially normal to the upper and lower walls of the bridge member 111 and extending therethrough, the pivot pin 113 being mounted in a pair of axially aligned radially flanged bearings 114 respectively disposed in complementary openings in the upper and lower walls of the bridge member 111. The upper end of the pivot pin 113 may be externally threaded and secured to the bridge member 111 by a nut 116. The lower end of the pivot pin 113 is received in a complementary opening 115*a* in a pivot block 115, the pivot block 115 having an arcuate lower surface and a flat upper surface disposed substantially parallel to the lower surface of the bridge member 111 and spaced a short distance therebelow. Disposed through another complimentary opening in the pivot block 115, is a cylindrical core member 117 having a longitudinal axis which intersects the longitudinal axis of the pivot pin 113 at substantially right angles thereto. The lower end of the pivot pin 113 is secured to the cylindrical core member 117 intermediate the ends thereof, which ends are respectively equidistantly spaced outwardly from the opposite sides of the pivot block 115. A pair of radially flanged bearings 119 are respectively fitted into the opposite ends of the cylindrical core 117, for supporting therethrough a shaft 118 coaxial withthe cylindrical core member 117 and freely rotatable about the longitudinal axis thereof. The opposite ends of the shaft 118 respectively extend outwardly beyond the opposite ends of the cylindrical core member 117 and respectively carry thereon a pair of guide rollers, generally designated by the numeral 120. Each of the guide rollers 120 is cylindrical in shape and is supported on the adjacent end of the shaft 118 by annular support spacers 121 and 122, the spacer 121 being disposed adjacent to the associated end of the cylindrical core member 117 and the spacer 122 being disposed adjacent to the outer end of the shaft 118 and the guide roller 120 and forming an end cap for the guide roller 120. The outer surface of each of the guide rollers 120 is coated with a coarse frictional material 123 for frictionally engaging an associated towel web 50 as will be described more fully hereinafter.

Each of the feed-directing assemblies 110 is also provided with a towel follower or sensing member, generally designated by the numeral 125, the follower comprising a substantially flat, wedge-shaped plate 126 having a narrow front end overlying the upper surface of the pivot block 115 and secured thereto by suitable fasteners 127, and a wide rearward end disposed rearwardly of and below the pivot block 115. The rearward end of the plate 126 is provided on the opposite side edges thereof with a pair of downwardly extending, generally triangular wings 128. The rearward end of the plate 126 has a width substantially equal to the width of the associated feed lane, the downwardly extending wings 128 being adapted to straddle the associated towel web 50 in a manner to be described more fully hereinafter. The pivot block 115 and the shaft 118, guide rollers 120 and towel follower 125 coupled thereto, are all pivotally movable about the axis of the pivot pin 113 and the guide rollers 120 are freely rotatable about the longitudinal axis of the shaft 118, all for facilitating the feed-directing function of the assembly 110 as will be described in detail hereinafter.

Figure 2:
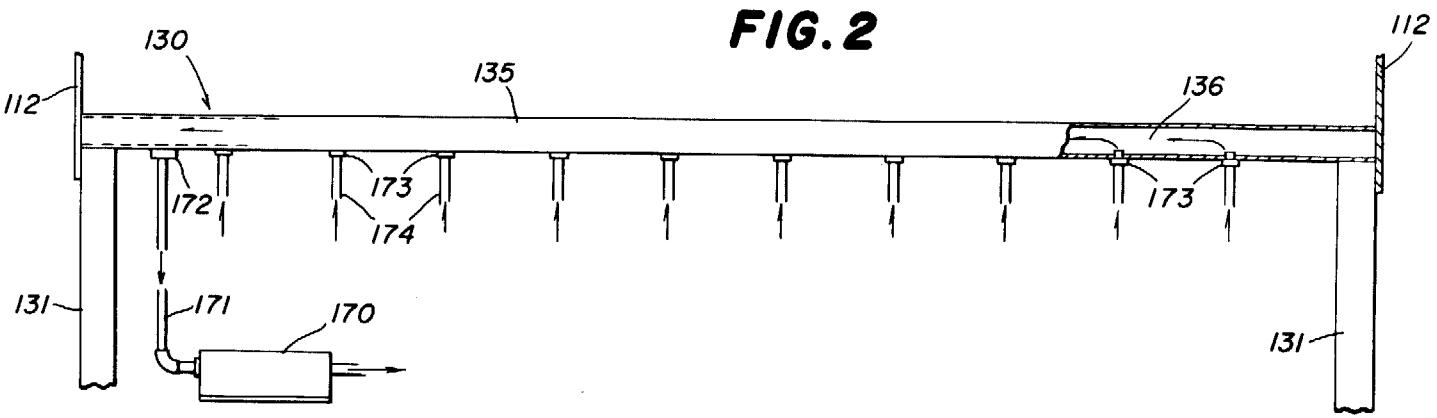
FIG. 2 is a fragmentary view in partial section of the front frame of the towel winder of FIG. 1, and showing how the frame crossbar acts as a manifold for the suction pump.

Referring now to FIGS. 1 and 2 of the drawings, there is shown a forward supporting framework, generally designated by the numeral 130 and preferably formed of steel, for supporting the winding units 150 of the towel winding machine 100. The framework 130 includes a pair of upstanding posts 131 connected at the lower ends thereof to foot plates 132 which are supported upon the floor or other supporting surface 133. Interconnecting the posts 131 at the upper ends thereof is a tubular cross beam 135 having a substantially rectangular cross section and disposed substantially horizontally. Respectively connected to and closing the opposite ends of the tubular cross beam 135 and extending upwardly therefrom substantially normal thereto are the pair of end plates 112, the upper ends of the plates 112 supporting the opposite ends of the feed conveyor drive 106*a* as described above. Also, extending between the end plates 112 just forwardly of the drive roll 106 and substantially parallel thereto is a cross bar 137 for a purpose to be described more fully hereinafter. It will be noted that the end plates 112 cooperate with the hollow cross beam 135 to define therein a closed chamber 136.

Figure 7:
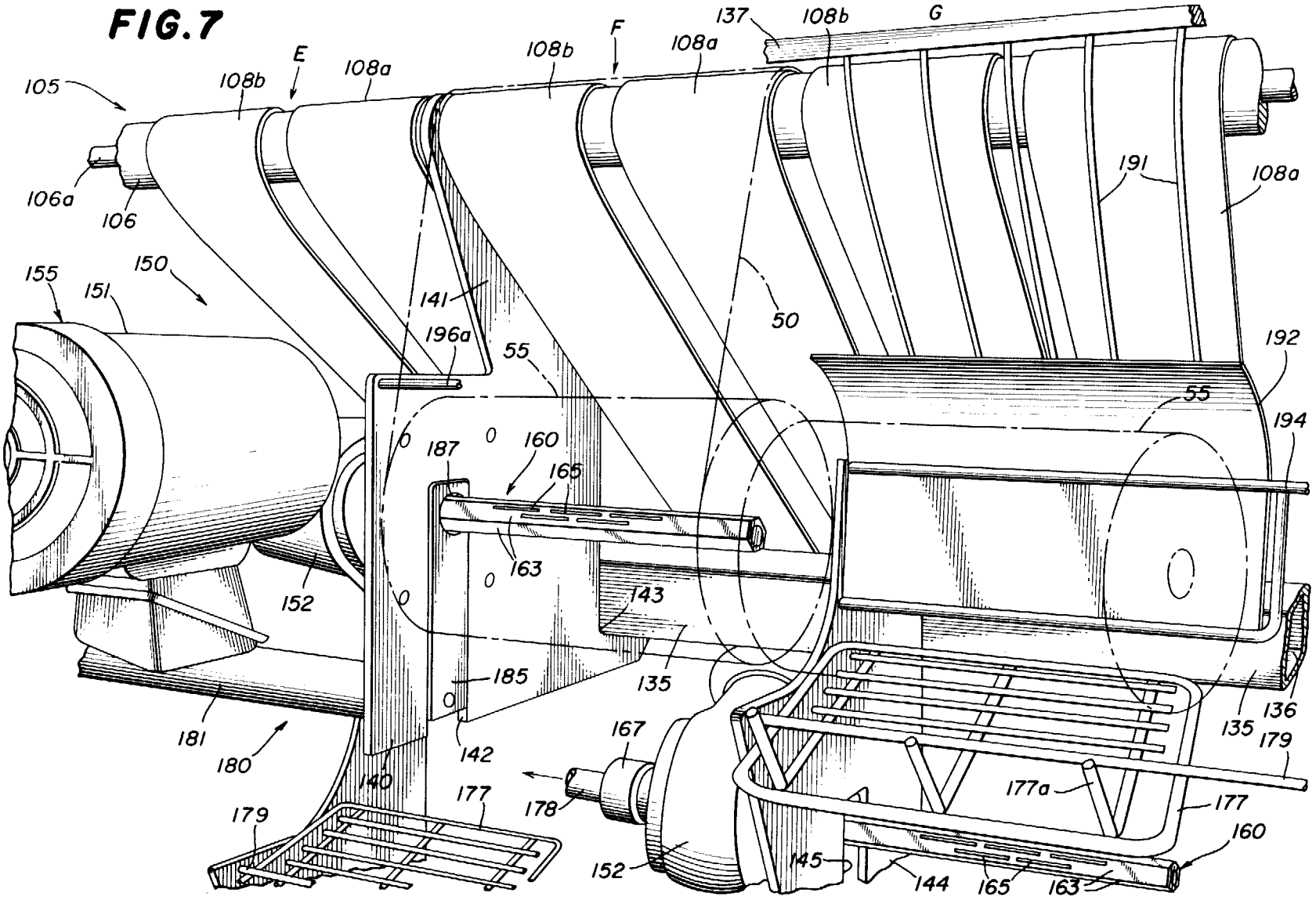
FIG. 7 is an enlarged fragmentary front perspective view of the towel winding machine of FIG. 1 showing the operation of the towel roll ejector and receptacle.
Figure 8:
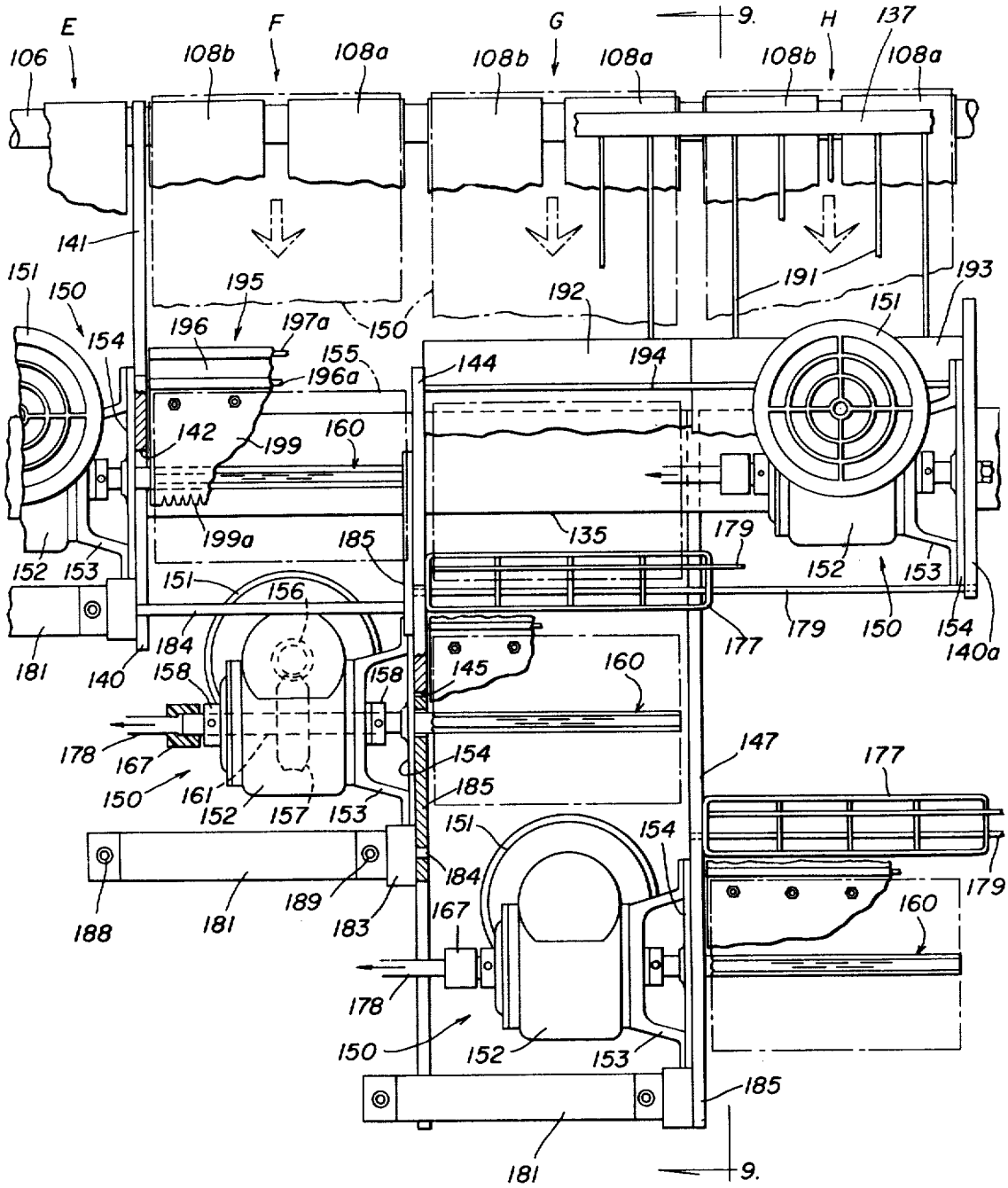
FIG. 8 is an enlarged fragmentary front elevational view of the towel winding machine of FIG. 1 showing three of the intermediate winding units and the orientation of the capture guide apparatus with respect to the mandrels.
Figure 9:
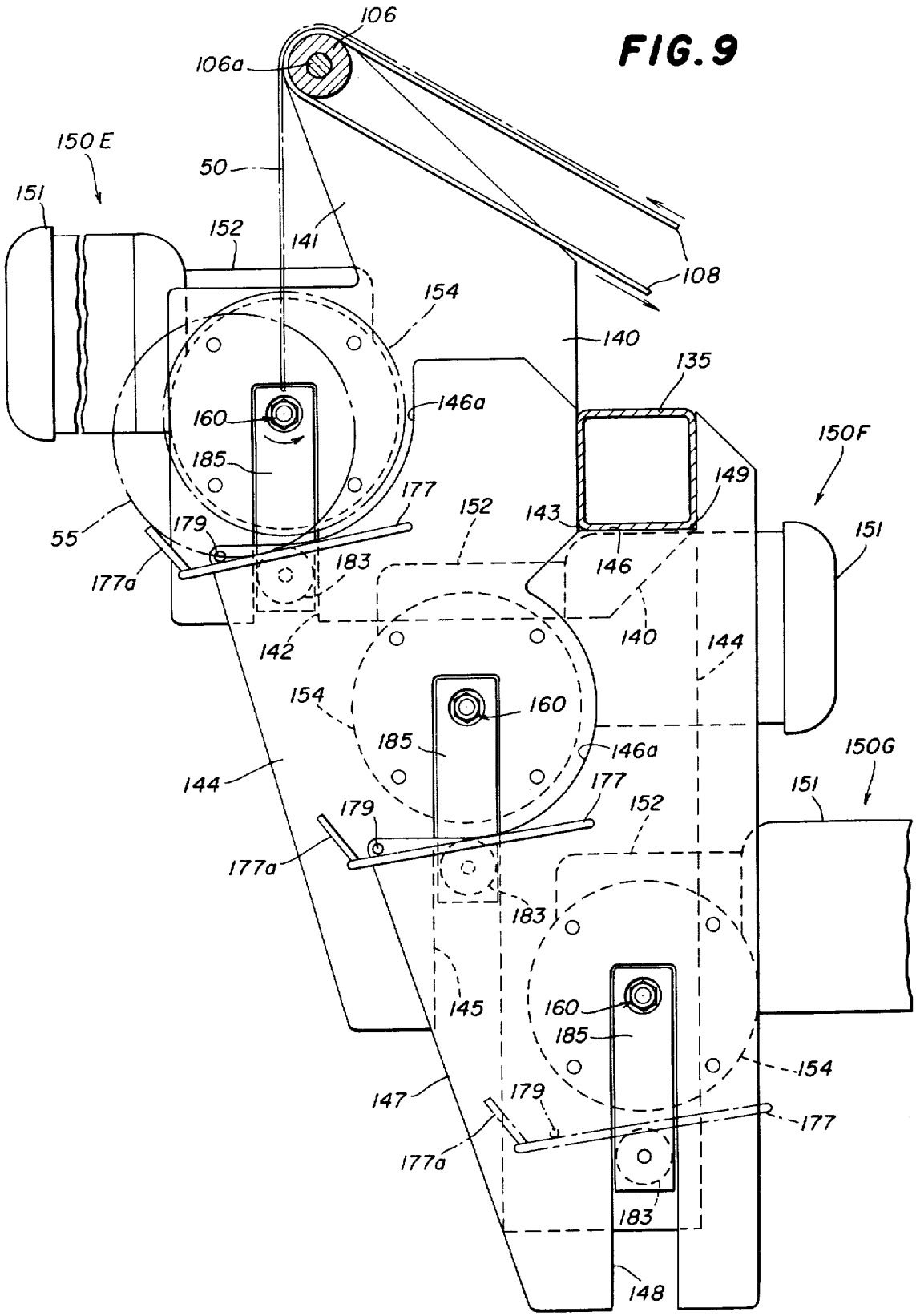
FIG. 9 is a further enlarged composite view taken along the line 9—9 in FIG. 8 and showing the upper level and lower level and intermediate level support plates for the winding units and also showing the vertical and horizontal staggering of the winding units on the frame.

Referring now also to FIGS. 7 to 9 of the drawings, there are provided a plurality of flat, relatively thin upstanding plates of different shapes, including upper support plates 140 and 140*a*, intermediate support plates 144 and lower support plates 147, all carried by the cross beam 135 and respectively disposed at the side boundaries of the feed lanes A to J substantially parallel to one another. More particularly, the support plate 140 lies in the vertical midplane of the winding machine 100 and separates the feed lane E from the feed lane F. The support plate 140 is generally rectangular in shape and is provided at the upper end thereof with a forwardly and upwardly extending arm 141 having an opening in the upper end thereof for accommodating therethrough the drive shaft 106*a* of the feed conveyor 105. Formed in the rear edge of the support plate 140 is a right angle notch or recess 143 shaped complementary to the cross beam 135 and receiving the cross beam 135 therein, whereby the plate 140 abuts against and is welded to the front and bottom walls of the cross beam 135, all for securely supporting the mounting plate 140 on the cross beam 135. Extending vertically upwardly from the bottom edge of the support plate 140 adjacent to the front end thereof is a substantially rectangular slot 142. Disposed three lanes to either side of the support lane 141, i.e., between feed lanes B and C and between feed lanes H and J, are support plates 140*a* which are each constructed substantially identically to support plate 140 with the exception that the plates 140*a* are not provided with the mounting arm 141. The support plates 140*a* are each disposed vertically and are connected to the cross beam 135 in the same manner as is support plate 140.

Respectively disposed at the left-hand edge of feed lane A, between feed lanes C and D, between feed lanes F and G, and between feed lanes I and J, are four identically-constructed intermediate support plates 144, each of the support plates 144 being disposed parallel to the central support plate 140, but displaced a short distance downwardly and rearwardly therefrom. The support plates 144 are all identically constructed and have an irregular shape provided at the upper rear corner thereof with a notch 146 for accommodating the cross beam 135 therein, whereby the support plates 144 are connected to the cross beam 135 by appropriate means such as welding. Extending vertically upwardly from the bottom edge of each of the support plates 144, approximately midway between the front and rear ends thereof, is a substantially rectangular slot 145. An arcuate recess 146*a* is formed in the top front edge of the plate 144.

Respectively disposed between the feed lanes A and B, between the feed lanes D and E, and between the feed lanes G and H, are three identically-constructed lower support plates 147, all disposed parallel to the intermediate support plates 144 but displaced downwardly and rearwardly a short distance therefrom. The support plates 147 are each provided at the upper end thereof with a notch 149 for accommodating the cross beam 135, whereby the support plates 147 are connected to the cross beam 135 by appropriate means such as welding. Extending vertically upwardly from the bottom end of each of the support plates 147, intermediate the front and rear ends thereof, is a substantially rectangular slot 148. An arcuate recess 149a is formed in the top front edge of the plate 147.

It will be noted that the support plates 140, 140*a*, 144 and 147 comprise a total of ten support plates, and when the support plates 140 and 140*a* are considered to be the same, it can be seen that these ten plates are arranged in an alternating pattern on the frame 130. Thus, beginning at the left-hand edge of feed lane A as viewed in FIG. 1, the plates are arranged from left to right in a repeating pattern as follows: an intermediate plate 144, a lower plate 147, an upper plate 140, an intermediate plate 144, a lower plate 147, etc., with a plate disposed at the left-hand boundary of each of the feed lanes A to J. Each cycle of this repeating pattern includes a set of three support plates, i.e., an upper support plate 140, an intermediate support plate 144 and a lower support plate 147, one of these sets of three support plates being illustrated in FIGS. 8 to 10 of the drawings. Referring to FIG. 9 it can be seen that the support plates 140 (or 140a), 144 and 147 in each set of the pattern are staggered horizontally and vertically on the frame 130 in such a manner that the upper ends of the slots 142, 145 and 148 are spaced equidistantly from one another. More particularly, the upper end of the slot 145 is disposed below and rearwardly of the upper end of the slot 142, and the upper end of the slot 148 is disposed below and rearwardly of the upper end of the slot 145, all for a purpose to be described more fully hereinafter.

Figures 3, 4, 5, 6:
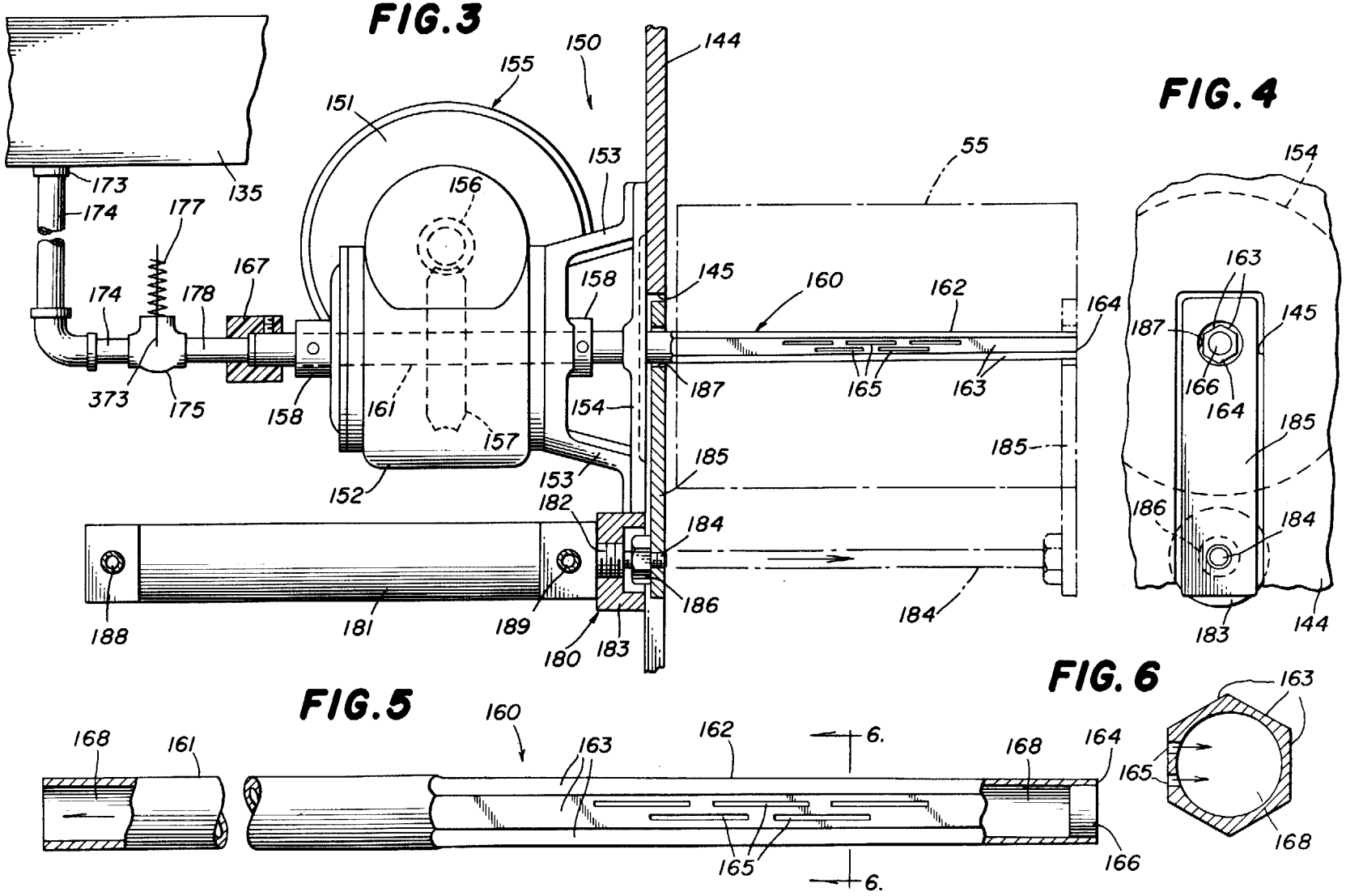
FIG. 3 is an enlarged front elevational view of one of the winding units of the towel winding machine of FIG. 1, showing the connection between the mandrel and the frame crossbar and showing the ejector arm in its retracted position in solid lines and in its ejecting position in phantom.
FIG. 4 is a fragmentary side elevational view of the winding unit of FIG. 3.
FIG. 5 is a further enlarged front elevational view in partial section of the mandrel of the winding unit of FIG. 3 with a portion of the inner end of the mandrel removed.
FIG. 6 is a further enlarged cross-sectional view of the mandrel taken along the line 6—6 in FIG. 5.

Respectively mounted on the frame 130, and more particularly on the support plates 140 (or 140a), 144 and 147, are a plurality of winding units, generally designated by the numeral 150, each in number to the feed lanes of the winding machine 100. The winding units 150 are all of identical construction whereby only one of these units will be described in detail. Referring, for example, to FIGS. 3 through 7 of the drawings, the winding unit 150 comprises a drive motor 155, a winding mandrel 160, and an ejector unit 80. The drive motor 155 is preferably a gear head motor of the constant-torque type and is provided with a generally cylindrical motor housing 151 and a generally cylindrical gear head housing 152 connected to the motor housing 151, with the longitudinal axis of the gear head housing 152 disposed substantially normal to the longitudinal axis of the motor housing 151. Spaced circumferentially around the right-hand end of the gear head housing 152, as viewed in FIG. 3, and extending outwardly therefrom are a plurality of mounting legs 153, connected at the outer ends thereof to a substantially circular mounting plate 154. In use, the mounting plate 154 is disposed parallel to the associated one of the support plates 140 (or 140*a*), 144 or 147 (a plate 144 is shown in FIG. 3) and is fastened to the left-hand side thereof (as viewed in FIG. 3) by suitable fastening means such as screws or bolts for supporting the drive motor 155 on the support plate 144. The mounting plate 154 is so oriented that the axis thereof passes through the vertical midline of the slot 145 in the support plate 144, a short distance below the upper end of the slot 145. The output shaft of the drive motor 155 is provided with a worm 156 adapted for meshing engagement with a worm gear 157 in the gear head housing 152. Connected to the opposite ends of the gear head housing 152 and coaxial therewith are a pair of bearings 158. The mandrel 160 is disposed substantially horizontally and has a cylindrical inner portion 161 (disposed to the left in FIG. 3) and an outer portion 162, the inner portion 161 extending through the slot 145 in the support plate 144, through a complementary opening centrally disposed in the mounting plate 154 and through the bearings 158 and gear head housing 152 coaxial therewith, the inner portion 161 of the mandrel 160 being coupled to the worm gear 157, whereby the mandrel 160 is rotatably driven about the longitudinal axis thereof in a counterclockwise direction as viewed in FIGS. 9 and 10. The outer portion 162 of the mandrel 160 extends to the right of the support plate 144, as viewed in FIG. 3, and is substantially hexagonal in transverse cross section, being provided with six equal outer side faces 163. The mandrel 160 is of hollow metal tubular construction and is closed by a plug 166 force fed into the free distal end 164 thereof to define an enclosed chamber 168 therein. Formed in one of the side faces 163 of the mandrel 160 are a plurality of elongated slots or openings 165 communicating with the chamber 168.

The towel winding machine 100 is also provided with a suction pump 170, which is coupled by means of a connecting pipe or conduit 171 to a fitting 172 extending through one wall of the hollow cross beam 135, whereby communication is provided between the suction pump 170 and chamber 136 in the cross beam 135. A plurality of input fittings 173 equal in number to the winding units 150 are also provided through the wall of the cross beam 135. Coupled to each of the fittings 173 is a lead conduit or pipe 174 which is in turn coupled to a control valve 175, which is in turn coupled to connector 178, the connector 178 being coupled to the open inner end of the mandrel 160 by an air-tight nylon coupler 167 which permits free rotation of the mandrel 160 therein. Thus, it can be seen that the hollow cross beam 135 acts as a manifold between the suction pump 170 and the mandrels 160 of each of the winding units 150. The control valve 175 is preferably solenoid-actuated, and is provided with a solenoid armature 373 and a bias spring 177, the details of operation of the control valve 175 to be described hereinafter.

When the valve 175 is open, the suction pump 170 will draw air from the chamber 168 in the mandrel 160, thereby causing an area of reduced pressure in the chamber 168 and a consequent flow of air into the chamber 168 through the openings 165 in the side of the mandrel 160. There is thus created a vacuum or suction effect through the openings 165 for attracting the leading end of the towel web 50 to the mandrel 160 when the towel web 50 is fed to the vicinity of the mandrel 160 for automatically initiating the winding of the towel web 50 on the mandrel 160. Preferably, the suction pump 170 maintains a pressure within the chamber 168 of approximately 10 inches of mercury column, it having been found that this degree of vacuum will produce a sufficient suction through the openings 165 to effectively capture the leading end 52 of the towel web 50.

The winding unit 150 is also provided with an ejector unit, generally designated by the numeral 180, the ejector unit 180 preferably being fluid-actuated and including an air cylinder 181 provided with an externally threaded stud 182 at one end thereof. Threadedly engaged with the stud 182 is an annular mounting bracket 183 which abuts against the left-hand side of the support plate 144, as viewed in FIG. 3, immediately below the drive motor mounting plate 154. The cylinder 181 is disposed substantially horizontally and is provided with a movable piston 184 therein, the right-hand end of the piston 184 being externally threaded and extending outwardly beyond the stud 182. The longitudinal axis of the piston 184 passes through the vertical midline of the slot 145 of the support plate 144 substantially normal thereto, with the threaded end of the piston 184 extending through the slot 145. A flat, upstanding ejector arm 185 is coupled to the piston 184, the threaded end of the piston 184 being received through a complementary opening in the ejector arm 185 and secured thereto by a nut 186. The ejector arm 185 is shaped complementary to the slot 145 in the support plate 144 and has a thickness slightly less than the thickness of the support plate 144, whereby the ejector arm 185 may be nested within the slot 145. At the upper end of the ejector arm 185 is a circular opening 187 for accommodating the mandrel 160 therethrough. The cylinder 181 is provided with two air inlet ports 188 and 189 adapted for coupling to a suitable source of air (not shown) for moving the piston 184 between an ejecting position illustrated in phantom in FIG. 3, and a retracted position illustrated in solid line in FIG. 3. In the ejecting position thereof, the piston 184 is fully extended to the right of the cylinder 181, with the ejector arm 185 being disposed at the free distal end 164 of the mandrel 160. When the piston 184 is in its retracted position, it is fully withdrawn into the cylinder 181 with the ejector arm 185 disposed completely within the slot 145 in the support plate 144 so as not to interfere with the winding of the towel web 50 on the mandrel 160 as will be described below.

It will be noted that the mandrel 160 has a length nearly equal to twice the width of the associated feed lane, whereby the tapered portion 162 of the mandrel extends substantially across the associated feed lane, while the cylindrical end 161 of the mandrel 160 and the drive motor 155 coupled thereto are disposed in longitudinal alignment with an adjacent feed lane, viz., the feed lane immediately to the left of the feed lane associated with the winding unit 150. In addition, it will be noted that the cylinder 181 of the ejector unit 180 is also disposed in longitudinal alignment with the feed lane adjacent to the left-hand side of the associated feed lane. In fact, the cylinder 181 has a length greater than the length of the feed lane, whereby it extends even beyond the adjacent feed lane, as indicated, for example, in FIG. 8. Furthermore, each of the winding units 150 is provided with a towel roll receptacle or catcher 177, which is of a wire or rod mesh construction, and is disposed beneath and immediately to the right of the free distal end 164 of the mandrel 160, as indicated in FIGS. 7 and 9. Since the mandrel 160 extends across substantially the entire width of the associated feed lane, the roll receptacle 177 is disposed in longitudinal alignment with the next adjacent feed lane to the right of the associated feed lane as viewed in FIG. 8, the receptacle 177 being supported between the support plates bordering the adjacent feed lane by means of a mounting rod 179, the receptacle 177 being tilted slightly downwardly and forwardly of the winding machine 100 and being provided with a plurality of upturned prongs 177*a* at the forward end thereof for retaining the associated towel roll thereon. Thus, it can be seen that while the winding unit 150 is associated with only one of the feed lanes A to J, it has an overall width substantially equal to the combined widths of three such feed lanes. For example, referring to FIG. 8, the winding unit 150 associated with feed lane G has a mandrel 160 with the tapered section 162 disposed in feed lane G, and with the cylindrical section 161 and drive motor 155 and ejector cylinder 181 disposed in alignment with feed lane F, and with the roll receptacle 177 disposed in feed lane H.

Accordingly, in order to accommodate the winding units 150 in a space having approximately the same width as the feed conveyor 105, i.e., a width substantially equal to the combined widths of the feed lanes A to J, it is necessary to stagger the winding units 150 on the frame 130. This staggering is accomplished by the staggering of the support plates 140 (or 140*a*), 144 and 147 described above. Considering, for example, a set of three such support plates as is set forth in FIG. 9, it will be apparent that when the winding units 150 for each of the feed lanes A to J are mounted on the support plates as described above, i.e., with the mandrel 160 and the ejector arm 185 disposed in the rectangular slot of the associated support plate, there will result a horizontal and vertical staggering of the winding units 150 wherein a winding unit 150 associated with an intermediate support plate 144 is disposed below and rearwardly of a winding unit 150 associated with an upper support plate 140 and is disposed above and forwardly of a winding unit 150 associated with a lower support plate 147. Thus, neither the drive motor 155 nor the ejector cylinder 181 nor the roll receptacle 177 of the winding unit 150 will interfere with the mandrel 160 of an adjacent winding unit 150, but all ten of the winding units 150 may be completely accommodated in a space having a width only slightly greater than the combined widths of the feed lanes A to J.

Referring to FIG. 1, it will be seen that this staggered arrangement of the winding units 150 results in a pattern wherein each of the intermediate feed lanes B to I has the mandrel 160 of the associated winding unit 150 disposed therein, with the drive motor 155 and ejector cylinder 181 of one adjacent winding unit 150 and with the roll receptacle 177 of the other adjacent winding unit 150 disposed in longitudinal alignment with the feed lane but displaced therefrom. One of the end feed lanes, i.e., feed lane J, has the mandrel 160 of the associated winding unit 150 disposed therein and has the towel roll receptacle 177 associated with the feed lane I disposed in longitudinal alignment with the feed lane J but displaced therefrom, there being no drive motor 155 in longitudinal alignment with the feed lane J. The other end feed lane, i.e., feed lane A, has the mandrel 160 of the associated winding unit disposed therein, and has the drive motor 155 associated with the feed lane B disposed in longitudinal alignment with the feed lane A but displaced therefrom, there being no roll receptacle 177 in alignment with the feed lane A. It will also be noted that the framework 130 must be slightly wider than the total width of the feed lanes A to J in order to accommodate the drive motor 155 associated with the feed lane A and the roll receptacle 177 associated with the feed lane J.

Figure 10:
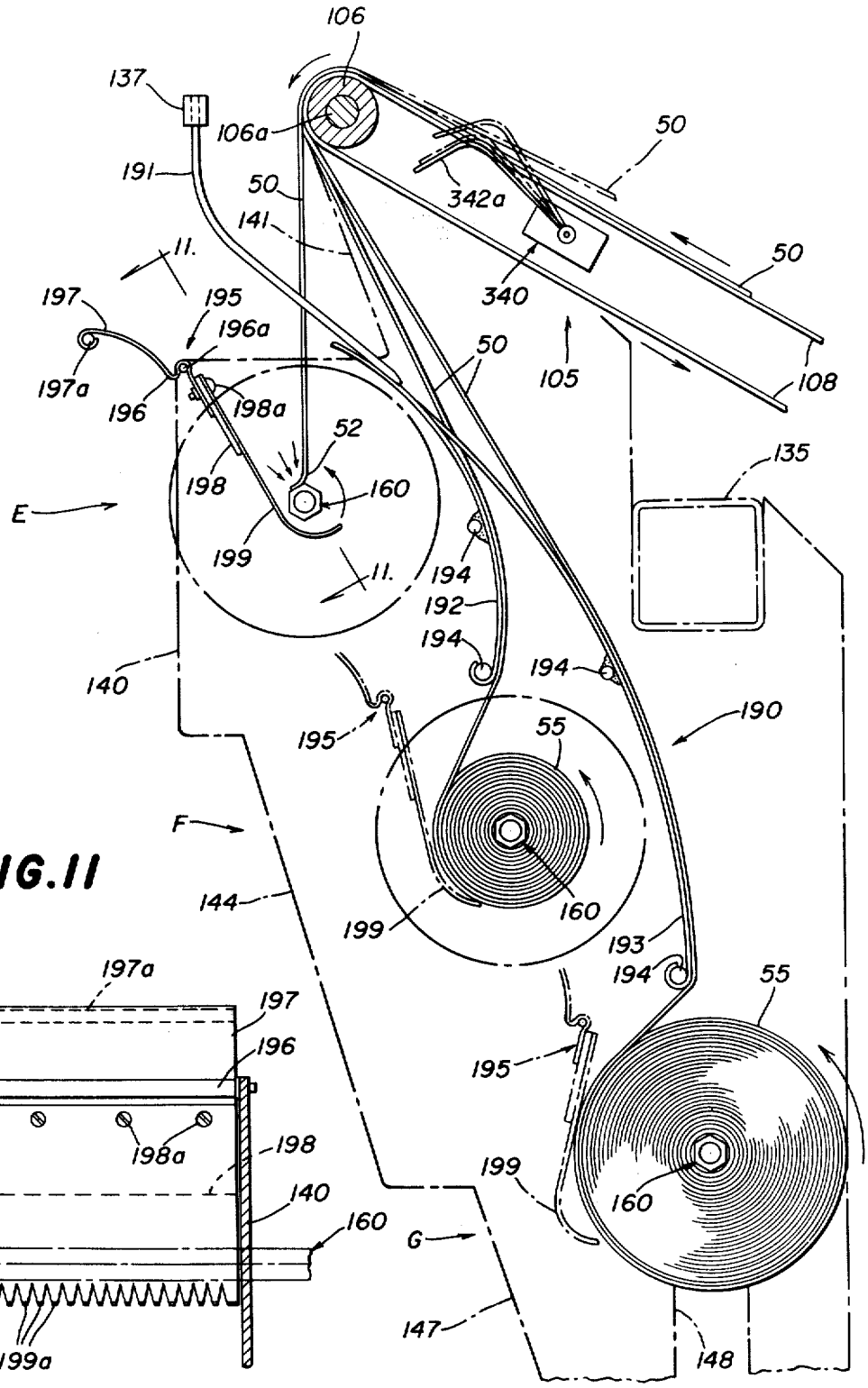
FIG. 10 is a composite view similar to FIG. 9, but showing the guide chutes and capture guide retainers for the winding units and the cooperation of one of the control switches with the towel web.
Figure 11:
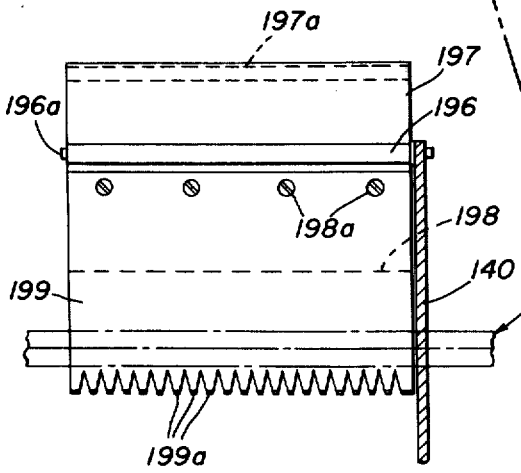
FIG. 11 is a front elevational view of one of the capture guide retainers of FIG. 10.

Referring now to FIG. 10 of the drawings, it will be seen that when the leading end 52 of a towel 50 is fed from the discharge end of the feed conveyor 105 it falls vertically under the force of gravity to the associated winding unit 150. Accordingly, it is desirable that the associated winding unit 150 be so positioned on the frame 130 that the mandrel 160 will lie directly beneath the discharge end of the feed conveyor 105 so that the leading end of the associated towel web may fall directly thereupon. However, by reason of the horizontal staggering of the winding units 150 described above, only certain ones of the winding units 150 may be so positioned. As described above the winding units 150 have been arranged in three vertically spaced-apart horizontal levels, an upper level including the three winding units 150 associated with the upper support plates 140 (or 140a), an intermediate level including the four winding units 150 associated with the intermediate support plates 144 and a lower level including the three winding units 150 associated with the lower support plates 147. The winding units 150 have been so arranged on the frame 130 that the mandrels 160 of the upper level winding units 150 are disposed directly beneath the discharge end of the feed conveyor 105, whereby the leading ends 52 of the associated towel webs 50 may fall directly onto these upper level mandrels 160. However, the intermediate level and the lower level mandrels 160 are displaced rearwardly of the discharge end of the feed conveyor 105, and there is therefore provided a plurality of guide chute assemblies, generally designated by the numeral 190, for respectively guiding the associated towel webs 50 to the mandrels 160 of these rearwardly displaced winding units 150.

More particularly, each of the lower level and intermediate level winding units 150 is provided with a plurality of parallel, spaced-apart curved guide rods 191 disposed in the associated feed lane, each of the guide rods 191 being connected at the upper end thereof to the cross bar 137 and extending downwardly and rearwardly therefrom to a point above and rearwardly of the portion of the adjacent winding unit 150 aligned with the associated feed lane. Each of the intermediate level winding units 150 is provided with a curved guide chute 192 which may preferably be formed of sheet metal and extends downwardly and rearwardly from the rearward end of the associated guide rods 191, behind the towel receptacle 177 the adjacent winding unit 150 aligned with the associated feed lane, and terminating in a lower end disposed directly above the associated mandrel 160, the guide chute 192 cooperating with the associated guide rods 191 for guiding the leading end 52 of the associated towel web 50 to the mandrel 160 of the associated intermediate level winding unit 150. Each of the lower level winding units 150 is provided with a curved guide chute 193, which may also be formed of sheet metal, and extends downwardly and rearwardly from the bottom ends of the associated guide rolls 191, behind the drive motor 155 and roll receptacle 177 of the adjacent upper level and intermediate level winding units 150 aligned with the associated feed lane, and terminating in a lower end disposed directly above the associated mandrel 160, the guide chute 193 cooperating with the associated guide rods 191 for guiding the leading end 52 of the associated towel web 50 to the mandrel 160 of the associated lower level winding unit 150. Each of the guide chutes 192 and 193 is mounted between the support plates bordering the associated feed lane by means of mounting rods 194.

As was indicated above, each of the drive motors 155 is provided with a right angle housing which includes a motor housing 152 and a gear head housing 151. The drive motors 155 of each of the intermediate level and lower level winding units 150 are so arranged that the motor housing 151 extends rearwardly of the gear head housing 152. However, as indicated in FIGS. 1, 8 and 9, the drive motors 155 of the upper level winding units 150 must be so arranged that the motor housings 151 thereof extend forwardly of the associated gear head housings 152 in order that the motor housings 151 will not interfere with the guide rods 190 and guide chutes 193 disposed in the feed lanes with which the upper level drive motors 155 are aligned.

In order to insure that the leading end 52 of the towel web 50 fed from the feed conveyor 105 will be held in close proximity to the mandrel 160, each of the winding units 150 is provided with a guide retainer 195, the guide retainer 195 comprising a pivot bracket 196 mounted for pivotal movement about a pivot pin 196a which is supported at the opposite ends thereof by the support plates bordering the associated feed lane and is disposed above and forwardly of the mandrel 160 substantially parallel to the longitudinal axis thereof. The pivot bracket 196 is provided with a forwardly extending flange 197, carrying at the outer end thereof a counterweight 197a. Connected to the pivot bracket 196 at the rearward end thereof is a guide plate 199, preferably formed of polyethylene and extending downwardly and rearwardly toward the associated mandrel 160. A polyethylene backing plate 198 is disposed between the pivot bracket 196 of the guide plate 199, all of these members being secured together by suitable fasteners 198a such as screws or bolts. The lower end of the guide plate 199 is curved beneath the mandrel 160 in the direction of rotation thereof and extends outwardly a short distance beyond the opposite side of the mandrel 160. The guide apparatus 195 is urged by the counterweight 197a into a rest position shown in FIG. 10, wherein the lower end of the guide plate 199 is disposed only a short distance away from the associated mandrel 160. The free edge of the curved lower end of the guide plate 199 is provided with a plurality of teeth or serrations **199*a*** therealong for a purpose to be explained more fully hereinafter.

In operation, a plurality of towel webs 50 equal in number to the feed lanes of the towel winding machine 100 and the ironer 60, may be simultaneously processed by the ironer 60 and the towel winding machine 100. In this case, the operation of each of the winding units 150 and the movement of each of the towel webs 50 along the feed conveyors 101 and 105 is identical, whereby the operation of only one of the winding units 150 will be described in detail. When the leading end 52 of the towel web 50 is fed from the discharge end of the steam chest 80, it falls upon the transfer conveyor belt 104 and is moved by the clockwise rotation thereof to the right as viewed in FIG. 13. By reason of the fact that the surface speed of the transfer conveyor belt 104 is substantially greater than the surface speed of the towel web 50 as it is fed from the ironer 60, the towel web 50 is fed smoothly along the transfer conveyor 101 without folding. The leading end 52 of the towel web 50 is fed from the transfer conveyor 101 to the input end of the feed conveyor 105, and is carried upwardly therealong to the discharge end thereof. As the leading end 52 of the towel web 50 passes over the movable contacts 376 and 342a of the control switches 375 and 340, respectively, it depresses these contacts into the closed positions thereof as will be explained more fully hereinafter. From the discharge end of the feed conveyor 105, the leading end 52 of the towel web 50 passes vertically downwardly under the force of gravity to the mandrel 160 of the associated winding unit 150. If the associated winding unit 150 is in the upper level on the frame 130, the leading end 52 of the towel web 50 will fall directly onto the mandrel 160 as was described above and as is illustrated in FIG. 10 of the drawings. If the associated winding unit 150 is in the intermediate level on the frame 130, the leading end 52 of the towel web 50 will fall onto the guide rods 191 and will be guided thereby and by the associated guide chute 192 to a point immediately above the associated intermediate level winding unit, from which point the leading end 52 of the towel web 50 will drop vertically onto the associated mandrel 160. If the associated winding unit 150 is disposed in the lower level on the frame 130, the leading end 52 of the towel web 50 will fall again onto the guide rods 191 and will be guided thereby and by the associated guide chute 193 to a point immediately above the associated mandrel 160 from which point it will drop vertically to the mandrel 160.

At this time, the rotation of associated mandrel 160 has been started and the suction valve 175 has been opened and the ejector arm 185 has been retracted, all by control apparatus which will be described below, and in order to insure that the leading end 52 of the towel web 50 will be maintained in close proximity to the rotating mandrel 160 and will not miss the mandrel 160, because of windage from fans or ventilating equipment for example, the guide plate 199 is provided for holding the towel web 50 close to the mandrel 160. Thus, if the leading end 52 of the towel web 50 is blown forwardly of the mandrel 160, it will fall upon the guide plate 199 and will be guided thereby downwardly beneath and around the mandrel 160 in the direction of rotation thereof. It will be noted that the lower end of the guide plate 199 has a normal or rest position disposed closely adjacent to the mandrel 160 for facilitating the operation of the capture means of the winding unit 150. Thus, when the face 163 of the mandrel 160 which is provided with the openings 165 rotates around to the side of the mandrel closest to the towel web 50, the suction through the openings 165 will readily draw the towel web against the mandrel 160 causing it to adhere thereto for initiation of the winding of the towel web 50 into a towel roll on the mandrel 160. Since the passage of the leading end 52 of the towel web 50 along the guide plate 199 may result in a certain amount of suction therebetween tending to cause the towel web 50 to adhere to the guide plate 199, the distal end of the guide plate 199 is provided with the serrations **199*a* thereon for breaking this suction and facilitating the capture of the towel web 50 from the guide plate 199 by the suction through the mandrel 160**.

It should be noted that at the time when the mandrel 160 first contacts the towel web 50 the drive motor 155 is unloaded and is, therefore, driving the mandrel 160 at a relatively high rotational speed such that the surface speed of the mandrel 160 is somewhat greater than the surface speed of the towel web 50 as it is fed from the feed conveyor 105. Thus, as the towel web 50 begins to be wound on the mandrel 160 it will be wound thereon faster than it is being fed from the feed conveyor 105. Since the towel web 50 is being held securely by the pinch rolls 90 of the ironer 60, the initiation of the winding of the towel on the mandrel 160 will cause tension in the portion of the towel web 50 extending between the mandrel 160 and the ironer 60 and the slack in this portion of the towel 60 will be taken up causing the towel web 50 to be moved from its lower feed path lying along the surfaces of the conveyor belts 104 and 108 to a second tensioned feed path in which a reach of the towel web 50 extends directly from the discharge end of the ironer 60 to the discharge end of the feed conveyor 105, spanning the transfer conveyor 101 and the input end of the feed conveyor 105 as is clearly indicated in FIG. 13.

Figure 13:
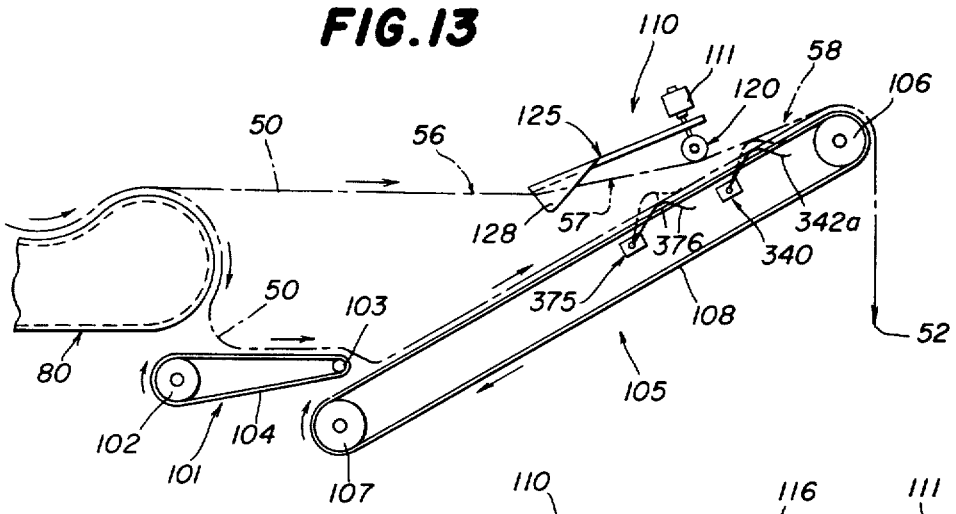
FIG. 13 is an enlarged side elevational view of the feed conveyors of the towel winding machine of this invention, showing the feed directing assembly and the two feed paths for the towel web.
Figure 14:
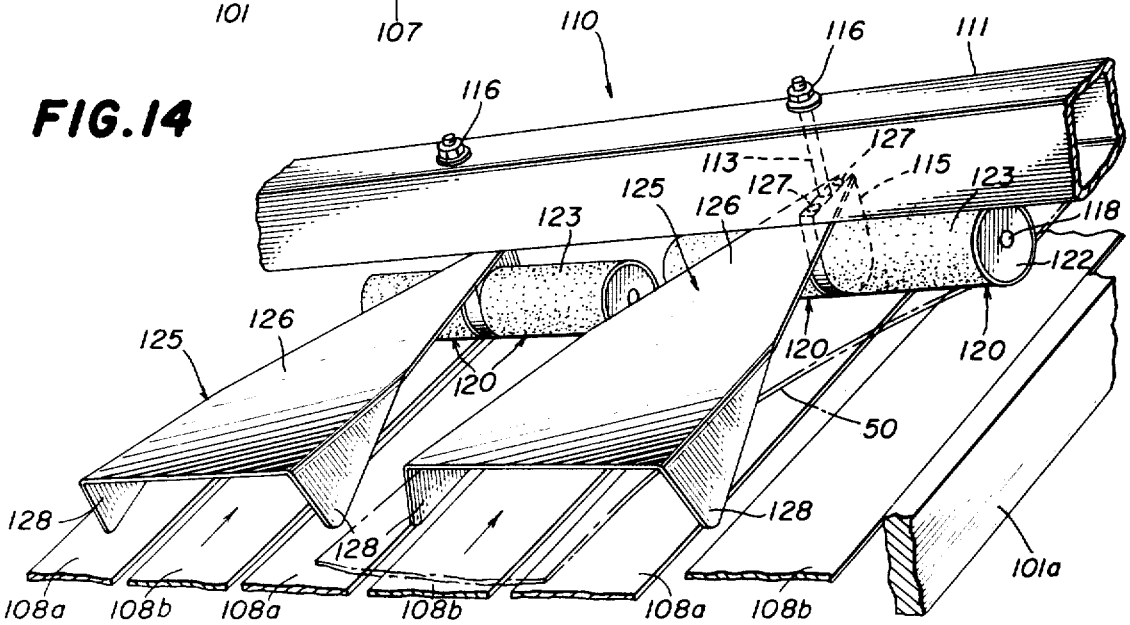
FIG. 14 is a further enlarged fragmentary front perspective view of the feed conveyor of FIG. 13, showing the cooperation of the feed-directing assemblies therewith.

Since the guide rollers 120 and the towel follower 125 of the associated feed-directing assembly are disposed below the level of the discharge end of the feed conveyor web 105, they will be engaged by the towel web 50 when it is pulled into its tensioned second feed path, as is indicated in FIG. 13. Thus, the towel web 50 in the second feed path thereof will be deflected by the feed-directing assembly 110 into three distinct sections or reaches, respectively generally designated by the numerals 56, 57 and 58, the first reach 56 extending substantially horizontally from the discharge end of the ironer 60 to the rearward end of the towel follower 125, the second reach 57 extending upwardly at a slight angle to the first reach 56 from the rearward end of the follower 125 to the bottom of the guide rollers 120, and the third reach 58 extending upwardly at a slight angle to the second reach 57 from the bottom of the guide rollers 120 to the discharge end of the feed conveyor 105. Referring to FIGS. 10 and 13 of the drawings, it will be seen that the reach 58 is disposed at a very slight angle to the surface of the feed conveyor belt 108 and is disposed only a slight distance thereabove. Thus, when the towel web 50 moves to the second feed path, the movable contact 342*a* of the switch 340 is able to move a slight distance upwardly, but not enough to open the switch 340, whereby the switch 340 is maintained in its closed condition by the towel web 50 in the second feed path thereof. However, the reach 57 of the towel web 50 is disposed at a substantial angle to the surface of the feed conveyor belts 108 and at a substantial distance thereabove, whereby when the towel web 50 is moved to the second feed path thereof, the movable contact 376 of the control switch 375 is permitted to move upwardly into its normally open position for opening the control switch 375.

It is essential for the proper operation of the winding machine 100 that the towel web 50 be maintained in its associated feed lane in a predetermined direction which will carry it to the associated mandrel 160 so as to be properly centered thereupon. As long as the towel web 50 is centered in the associated feed lane and is being fed in the predetermined direction, it will be centered between the wings 128 of the towel follower 125 out of contact therewith. However, if the towel web 50 should veer in the second feed path to either side of the associated feed lane and thus deviate from the predetermined direction, the edge of the towel web 50 will engage the inner surface of the adjacent wing 128, thereby urging the rearward end of the follower 125 in the direction of the deviation. For example, referring to FIG. 14, if the towel web 50 veers to the left of the predetermined direction, it will move the rearward end of the follower 125 to the left, thus pivoting the follower 125 in a counterclockwise direction about the pivot pin 113. Since the forward end of the follower 125 is connected to the pivot block 115 which is in turn connected to the shaft 118 of the guide rollers 120, the shaft 118 will also be pivoted in the counterclockwise direction about the axis of the pivot pin 113. This will result in the forward surfaces of rollers 120 being pointed toward the right, i.e., away from the direction of deviation of the towel web 50, and by reason of the frictional engagement between the towel web 50 and the coarse frictional surface 123 of the guide rollers 120, the guide rollers 120 will urge the towel web 50 to the right, i.e., away from the direction of deviation and back toward the predetermined direction. As the towel web 50 returns to the predetermined direction, it will engage the right-hand one of the wings 128 thus moving the follower 125 and rollers 120 back to a normal orientation centered with respect to the associated feed lane and the predetermined direction of the towel web 50. In this manner, the towel web 50 is continuously maintained in the predetermined direction so that, as it leaves the discharge end of the feed conveyor 105, it will be properly centered with respect to the associated mandrel 160 of the associated winding unit 150. In a constructional example of the feed-directing assembly 110, it has been found that the towel web 50 is maintained within one-fourth of an inch of the center of the associated feed lane.

As explained above, the drive motor 155 is preferably an induction motor of the constant-torque type and will, therefore, maintain a substantially constant torque at the mandrel 160. Thus, as the circumference of the towel roll 55 on the mandrel 160 increases, the load on the drive motor 155 also increases. Accordingly, in order that a substantially constant-torque may be maintained at the mandrel 160 the rotational speed of the drive motor 155 decreases, thereby decreasing the rotational speed of the mandrel 160. In this manner, the surface speed of the towel web 50 along the periphery of the towel roll 55 will be maintained substantially constant as the diameter of the towel roll increases so that the surface speed of the towel roll 55 will be substantially the same as the surface speed of the feed conveyor 105 to insure a smooth and even winding of the towel web 50 on the mandrel 160. It will also be noted that as the diameter of the towel roll 55 increases, the periphery thereof will engage the guide plate 199 thereby pivotally moving the guide plate 199 outwardly from the mandrel 160 about the pivot pin 196a for thereby accommodating the increasing diameter of the towel roll 55.

When the trailing end of the towel web 50 passes from the discharge end of the feed conveyor 105, the movable contact 342a of the control switch 340 is permitted to move to its normally open position, thereby opening the switch 340. The opening of the switch 340 serves to actuate the ejector unit 180 in a manner to be described more fully hereinafter. Thus, air will be fed from a suitable source (not shown) to the air inlet 188 of the cylinder 181 for moving the piston 184 to the right as viewed in FIG. 3, thereby carrying the ejector arm 185 to the right until it engages the left-hand end of the towel roll 55. As the piston 184 is moved to its fully extended position, the ejector arm 185 is moved to its ejecting position shown in phantom in FIG. 3, thereby moving the towel roll 55 from the mandrel 160 at the free end 164 thereof. When the towel roll 55 is thus removed from the mandrel 160, the guide plate 199 will be moved under the urging of the counterweight 197*a* back to the normal or rest position thereof closely adjacent to the mandrel 160. When the towel roll 55 has been removed from the mandrel 160 in the manner described it falls into the associated receptacle 177 and rolls downwardly therealong to the forward end thereof at which point it is retained by prongs 177*a* (see FIG. 7). Preferably, the receptacle 177 extends forwardly of the associated mandrel 160 a sufficient distance to permit accommodation of a plurality of ejected rolls thereon, which rolls may be periodically removed from the receptacle 177 by an attendant or by other appropriate means. The ejector arm 185 will remain in its ejecting position until the next towel web 50 is fed from the ironer 60 into the associated feed lane of the feed conveyor 105. When the leading end 52 of this next towel roll 50 engages and closes the movable contact 342*a* of the control switch 340, the ejector assembly 180 will be deactuated in such a manner that air will be forced into the air inlet 189 for moving the piston 184 to the left and thereby moving the ejector arm 185 back to the retracted position thereof within the slot 145 of the associated support plate 144. The timing of the apparatus is set so that the ejector arm 185 will be completely retracted before the leading end 52 of the next towel web 50 arrives at the mandrel 160 so as not to interfere with the winding of the towel web 50 on the mandrel 160.

Figure 18:
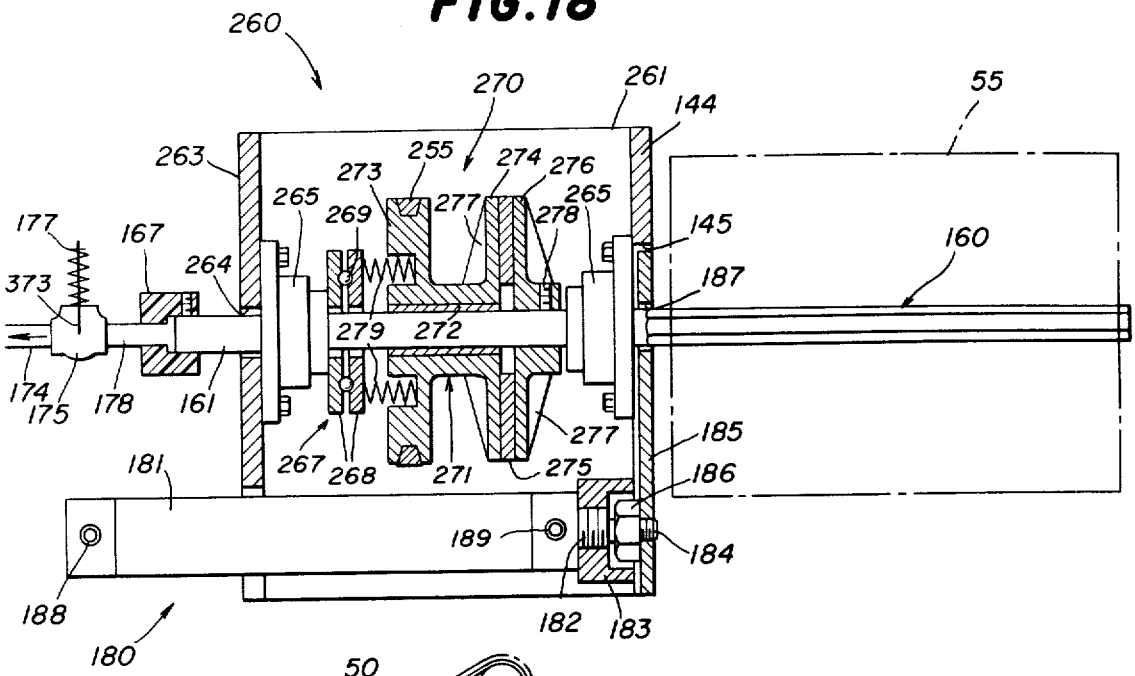
FIG. 18 is a front elevational view in partial section of one of the winding units of the towel winding machine of this invention showing an alternative embodiment of drive means including a slip-clutch assembly.
Figure 19:
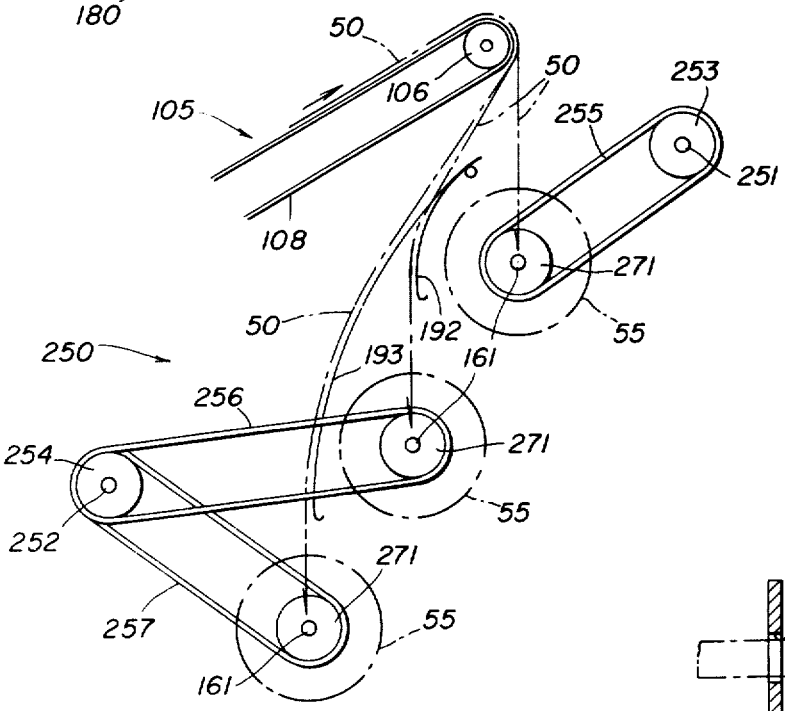
FIG. 19 is a fragmentary diagrammatic view in side elevation of the towel winding machine of this invention illustrating the line shafts in the alternative drive arrangement which utilizes the slip clutch of FIG. 18.

Referring now to FIGS. 18 and 19 of the drawings, there is shown an alternative embodiment of the drive means for the winding units 150 of this invention. In the embodiment of FIGS. 18 and 19, instead of each winding unit 150 having its own drive motor 155 there is a central drive motor (not shown) for the winding machine 100 which drives all of the winding units 150. The drive motor is preferably of a constant-speed type for driving the mandrels 160 so that in the unload conditions thereof they have a surface speed slightly greater than the surface speed of the feed conveyor 105. Coupled to the drive motor by appropriate means and rotatably driven thereby are two line shafts 251 and 252 respectively extending substantially the entire width of the winding machine 100 parallel to the drive shaft 106 of the feed conveyor 105. The line shaft 251 is disposed above and forwardly of the upper level of winding units 150, while the drive shaft 252 is disposed rearwardly of the lower level winding units 150. The upper line shaft 251 is provided with a plurality of sheaves or sprockets 253 therealong equal in number to the upper level winding units 150, the sprockets 253 being respectively coupled to the mandrels of the associated upper level winding units by drive belts or chains 255. Similarly, the lower line shaft 252 is provided with a plurality of sheaves or sprockets 254 therealong equal in number to the total of the lower and intermediate level winding unit 150, the sprockets 254 being respectively coupled to the mandrels 160 of the associated intermediate level winding units 150 by drive belts or chains 256 and being coupled to the mandrels 160 of the associated lower level winding units 150 by drive chains or belts 257. It is necessary that the upper level winding units 150 be driven from a position forwardly thereof because otherwise the guide chutes 192 and 193 leading to the lower level and intermediate level winding units 150 would interfere with the drive belts or chains 255. Similarly, it is necessary that the lower level and intermediate level winding units 150 be driven from rearwardly thereof, since otherwise the drive chains or belts 256 and 257 would interfere with either the winding or the ejection of the towel rolls 55 in adjacent feed lanes.

In order that a constant torque may be maintained at the mandrels 160 for decreasing the rotational speed thereof as the diameters of the towel rolls 55 increase for the reasons set forth above, each of the winding units 150 is provided with a slip clutch assembly, generally designated by the numeral 260, only one of which slip clutch assembly 260 will be described in detail. The slip clutch assembly 260 is provided with a channel-shaped housing 261 which is mounted on the left-hand side of the associated support plate 144 (for example) as viewed in FIG. 18, whereby it is disposed in longitudinal alignment with the feed lane adjacent to the left-hand side of the feed lane associated with the winding unit 150. The housing 261 has an outer flange 263 at the left-hand side thereof substantially parallel to the associated support plate 144, the flange 263 being provided with a circular opening 264 therethrough. Respectively mounted on the inner surfaces of the support plate 144 and the housing flange 263 are a pair of radially flanged bearings 265 arranged coaxially with each other and with the circular opening 264, the bearings 265 being securely fastened to the support plate 144 and the housing flange 263, respectively, by suitable fasteners such as screws or bolts passed through the outer bearing flanges. The cylindrical inner end of the mandrel 160 is passed through the slot 145 of the support plate 144 in the manner described above with respect to the embodiment of the FIG. 3, and is then passed through the bearings 265 and the circular opening 264 whereby the mandrel 160 is rotatably supported by the bearings 265. Disposed adjacent to the inner end of the left-hand one of the bearings 265, as viewed in FIG. 18, is a thrust bearing, generally designated by the numeral 267, and comprising a pair of identical parallel annular plates 268 arranged in surrounding relationship with the inner end 161 of the mandrel 160 coaxial therewith, and being separated by a bearing ring 269. Disposed adjacent to the inner end of the right-hand one of the bearings 265 is a slip clutch, generally designated by the numeral 270, and including an annular sheave 271 disposed in surrounding relationship with the inner end 161 of the mandrel 160 coaxial therewith and separated therefrom by a cylindrical sleeve 272. The sheave 271 is provided at the left-hand end thereof with a radially extending circular sprocket plate 273, and is provided at the right-hand end thereof with a radially extending backing plate 274. An annular clutch plate 276 is disposed immediately to the right of the backing plate 274 and is separated therefrom by an annular frictional disk 275, the clutch plate 276 having an outer diameter substantially equal to the outer diameter of the backing plate 274 and being fixed in position on the inner end 161 of the mandrel 160 by a set screw 278. The backing plate 274 and the clutch plate 276 are each provided with a plurality of radially extending cooling fins 277 spaced circumferentially therearound. A plurality of bearing springs 279 are spaced circumferentially about the right-hand one of the bearing plates 268. Each of the springs 279 extends substantially parallel to the mandrel 160, the right-hand ends of the springs 279 being received in complementary recesses in the sprocket plate 273 for urging the sheave 271 into frictional engagement with the friction plate 275 and the clutch plate 276. Formed around the periphery of the sprocket plate 273 is a recess for receiving an associated drive belt 255 for rotatably driving the slip clutch 270.

In operation, the frictional engagement between the sheave 271 and the clutch plate 276 by way of the friction plate 275 is such that when the mandrel 160 is unloaded, the rotational movement of the sheave 271 will be transmitted to the clutch plate 276 and by means of the set screw 278 to the mandrel 260 for effecting rotation thereof. However, as the circumference of the towel roll 55 increases, the drag on the clutch plate 276 increases so as to overcome the friction of the friction plate 275 and thereby provide slippage between the clutch plate 276 and the sheave 271. The friction between the sheave 271 and the clutch plate 276 is set at a predetermined value such that a substantially constant torque will be maintained in the mandrel 160, whereby the rotational speed of the mandrel 160 will decrease as the diameter of the roll 55 thereon increases to maintain the surface speed of the roll 55 in the step with the surface speed of the feed conveyor 105 for the reasons described above.

Figure 20:
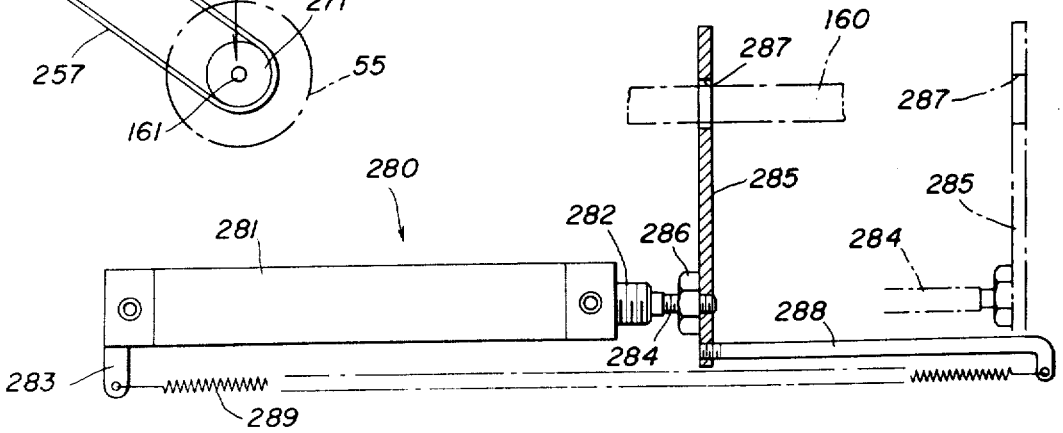
FIG. 20 is a front elevational view of an alternative embodiment of the roll ejector of this invention utilizing a spring return for the ejector arm.

Referring to FIG. 20 of the drawings, there is shown an alternative embodiment, generally designated by the numeral 280, of the ejector unit of this invention. The ejector unit 280 comprises a cylinder 281 being provided with a pair of air inlets and is substantially identical to the cylinder 181. The cylinder 281 is provided with an externally threaded stud at the right-hand end thereof for threaded engagement with a mounting bracket (not shown) which may be identical to the mounting bracket 183 in the embodiment of FIG. 3. Extending downwardly from the opposite end of the cylinder 281 is a tab 283. There is provided within the cylinder 283 a piston rod 284, the right-hand end of which is externally threaded and extends outwardly beyond the stud 282 and is threadedly engaged with an ejector arm 285 by means of a nut 286. The ejector arm 285 is substantially identical to the ejector arm 185 in the embodiment of FIG. 3, and is provided with an opening 287 therein for receiving the associated mandrel 160 therethrough. Threadedly engaged with the lower end of the ejector arm 285 is a spring-retaining rod 288 which extends outwardly to the right of the ejector arm 285 substantially normal thereto, the rod 288 being provided at the outer end thereof with a downturned projection 288*a*. Connected to the tab 283 and to the projection 288*a* and extending therebetween is a tension spring 289, which urges the ejector arm 285 into the retracted position thereof as explained above.

In operation, the ejector unit 280 is moved to the ejecting condition thereof in the same manner as is the ejector 180 in the embodiment of FIG. 3. However, when the ejector arm 285 has been moved to the ejecting position thereof (indicated in phantom in FIG. 20), and after the switch 340 has been closed by the presence of the next towel web 50 on the feed conveyor 105, the air inlet will be disconnected from the air source and connected to a metered exhaust port, whereby the ejector arm 285 will be returned to the retracted position thereof at a controlled slow rate under the urging of the tension spring 289.

Figure 21:
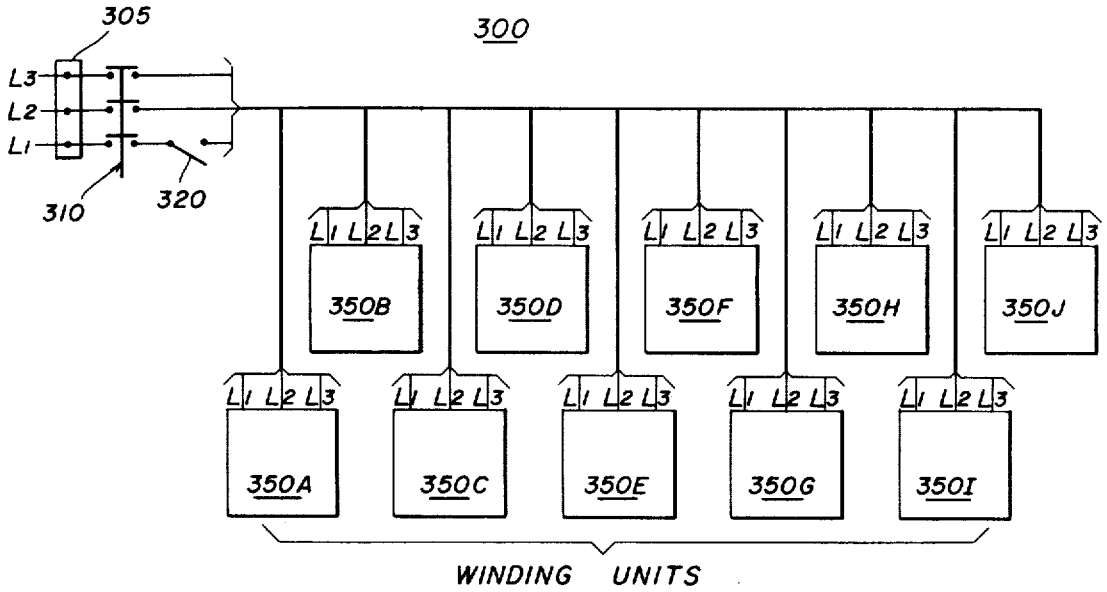
FIG. 21 is a schematic electric circuit diagram of the winding machine showing the coupling of a three-phase electric power source to each of ten identical winding units represented in block form.
Figure 22:
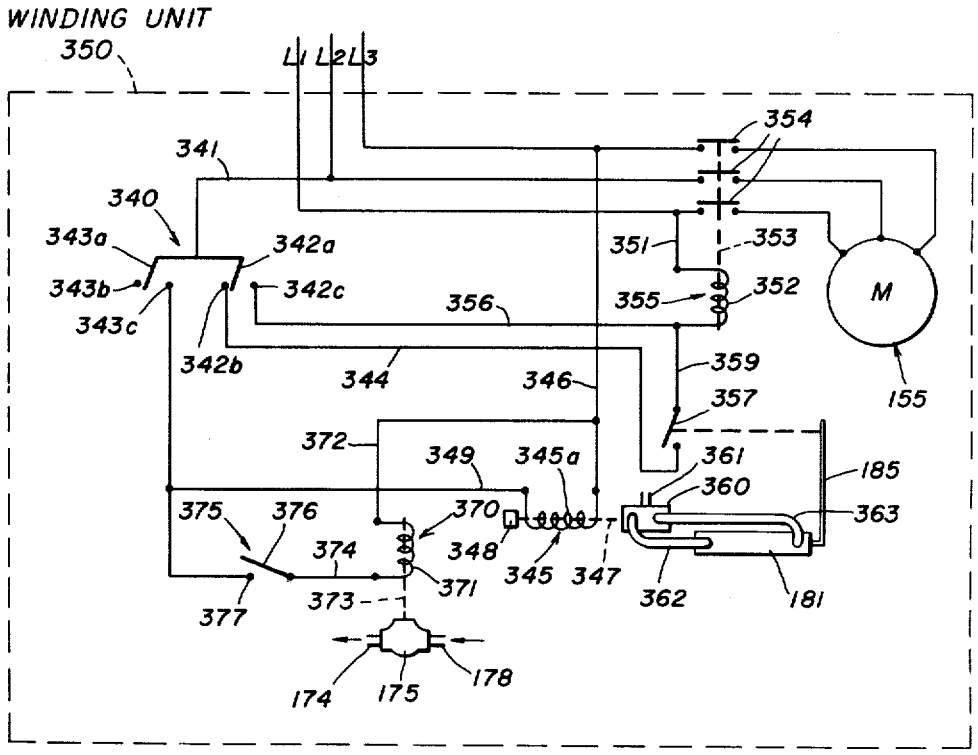
FIG. 22 is a detailed schematic circuit diagram of the control apparatus for one of the winding units of FIG. 21.

Referring now to FIGS. 21 and 22 of the drawings, there is illustrated the control apparatus 300 for the automatic winding machine 100, and, in particular, for the embodiment thereof illustrated in FIGS. 1 through 17 of the drawings. Each of the drive motors 155 is preferably of the three-phase type, adapted to be operated by a three-phase source of electrical power. Accordingly, referring to FIG. 21 of the drawings, there is shown the power lines L1, L2 and L3 of a three-phase source of alternating current electrical power, the lines L1, L2 and L3 leading from a terminal block 305 through a main circuit breaker 310 to each of the winding units of the winding machine. More particularly, the power lines L1, L2 and L3 are each connected to each of the winding units 350A to 350J in parallel, the individual winding units 350 being designated in block form in FIG. 21. There is also provided in the power line L1 a feed equipment interlock switch 320 which is coupled to the drive equipment of the associated ironer 60 and washing machine, the switch 320 being closed when the associated ironer and washing machine are operating and the switch 320 automatically opening when the associated ironer 60 or washing machine is stopped in order to cut off the power to the drive motors 155 of the winding units 350 in order to avoid damage thereto.

In FIG. 22, there is shown a detailed circuit diagram of the control apparatus for one of the winding units 350, the control circuitry of each of the windings 350 being identical. The power lines L1, L2 and L3 are connected to the three terminals of the constant torque drive motor 155 through the contacts 354 of a starting relay 355. The relay 355 is provided with a coil winding 352, one terminal of which is connected to the power line L1 by a conductor 351. The relay 355 is also provided with an armature 353 connected to the contacts 354 for effecting operation thereof, the contacts 354 being normally open and being closed upon energization of the relay 355. A double-pole, double-throw switch 340 is also provided and is mounted on the feed conveyor 105 as described above. One pole of the switch 340 comprises a movable contact 342*a* having a pair of fixed contacts 342*b* and 342*c*, the movable contact 342*a* being physically in the form of a curved wire and extending into the first feed path of the towel web 50 along the feed conveyor 105 as has been described above. The other pole of the switch 340 comprises a movable contact 343*a* and a pair of fixed contacts 343*b* and 343*c*. While only the movable contact 342*a* has been physically shown in the drawings (see FIG. 13), it will be appreciated that contact 342*a* is mechanically coupled to contact 343*a*, and any movement of one of these contacts results in a corresponding movement of the other in typical double-pole fashion. The switch 340 has a normally open position illustrated in FIG. 22, wherein the movable contact 342*a* is in contact with the fixed contact 342*b* and wherein the movable contact 343*a* engages the fixed contact 343*b*. The switch 340 will be in this normally open position when there is no towel web 50 in the first feed path along the feed conveyor 105. The movable contacts 342*a* and 343*a* of the switch 340 are connected to the power line L2 by a conductor 341. The other terminal of the relay coil 352 is connected to the fixed contact 342*c* of the switch 340 by a conductor 356, and is also connected by a conductor 359 to the movable contact of a switch 357, the fixed contact of the switch 357 being connected to the fixed contact 342*b* of the switch 340 by a conductor 344. The switch 357 is mechanically coupled to the ejector arm 185 of the ejector unit 180, so that the switch 357 is open when the ejector arm 185 in the retracted position thereof and the switch 357 is closed when the ejector arm 185 is in the ejecting position thereof.

The ejector unit 180 is controlled by a solenoid actuated valve 360 which is coupled by an inlet 361 to a suitable source of air (not shown). The control valve 360 is also coupled by conduits 362 and 363 respectively to the air inlets 188 and 189 of the cylinder 181. The valve 360 is controlled by a solenoid 345 which includes a coil winding 344a and an armature 347, the armature 347 being mechanically coupled to the valve 360. One terminal of the solenoid coil 345a is connected to the power line L3 by a conductor 346, the other terminal of the solenoid coil 345a being connected to the fixed contact 343c of the switch 340 by a conductor 349. The solenoid 345 is so arranged that it is normally deenergized when there is no towel in the associated feed lane of the conveyor 105, the armature 347 holding the valve 360 in such a condition that air passes through the conduit 362 into the cylinder 181 for holding the ejector arm 185 in the ejecting position thereof. When the solenoid 345 is energized, the armature 347 thereof changes the condition of the valve 360 so that air is passed through the conduit 363 to the cylinder 181 and air is exhausted from the cylinder 181 to the conduit 362 for moving the ejector arm 185 to the retracted position thereof. The armature 347 of the coil 345 is provided with an adjustable delay mechanism 348, which may be in the form of an adjustable restriction which creates a vacuum and delays the movement of the armature, the delay mechanism 348 preferably being set so that when the solenoid 345 is deenergized there will be a delay of approximately two seconds before the armature 347 actuates the valve 360, thus permitting the mandrel 160 to come to a stop before the ejector arm 185 is moved to the ejecting position thereof, as will be explained more fully below.

There is also provided a suction control valve solenoid 370 for controlling the operation of the suction valve 175. As was described above, the valve 175 is coupled by a connector 178 to open end of the mandrel 160 and is coupled by a conduit 174 to the manifold provided in the cross beam 135 of the frame 130. The solenoid 370 comprises a coil winding 371 and an armature 373, one terminal of the coil 371 being coupled by a conductor 372 to the conductor 346 and the other terminal of the coil 371 being connected to the conductor 349 by a conductor 374. The armature 373 is mechanically coupled to the valve 175, the solenoid 370 being so arranged that when it is energized the armature 373 will open the valve 175 thereby permitting passage of air therethrough, whereby the suction pump 170 will create a suction through the openings 165 in the mandrel 160 as described above. When the solenoid 370 is deenergized a coil spring 177 (see FIG. 3) will return the armature 373 to close the valve 175 thereby isolating the mandrel 160 from the suction pump 170 and permitting the pressure in the mandrel 160 to return to atmospheric pressure for terminating the suction through the openings 165. Disposed in the conductor 374 is a normally open switch 375 which includes a movable contact 376 and a fixed contact 377. As explained above the switch 375 is mounted on the feed conveyor 105 so that the movable contact 376 in the normally open position thereof is disposed in both the first and second feed paths of the towel web 50 along the feed conveyor 105.

The operation of one of the winding units 350 of the control apparatus 300 will now be described in detail. When there is no towel web 50 in the associated feed lane of the feed conveyor 105, the switches 340 and 375 will be in their normally open positions, whereby the relay 355 and the solenoids 345 and 370 are all deenergized. The winding unit 350 is designed to operate on a continuously repeating cycle as towels are repeatedly fed into the associated feed lane, and it will be simplest to described the detailed operation of one such cycle by beginning at the point therein when a completely wound towel roll has been ejected from the mandrel 160. When the ejector 180 is actuated to move the ejector arm 185 to its ejecting position for removing the wound towel roll 155 from the mandrel 160, this movement of the ejector arm 185 to its ejecting position will close the switch 357, thereby immediately energizing the starting relay 355 through a circuit including power line L3, conductor 351, relay coil 352, conductor 459, switch 357, conductor 344, contacts **342*a* and 342*b* of switch 340, conductor 341 and power line L2. This energization of the relay 355 will close the contacts 354 thereof, thereby completing an obvious circuit for energizing the drive motor 155 and thereby beginning rotation of the mandrel 160. Until the next towel web 50 is fed from the associated ironer 60, the motor 155 will run unloaded at relatively high speed which will facilitate the cooling of the motor 155. When the leading end 52 of the next towel web 50 is fed onto the feed conveyor 105 along the first feed path described above, it will engage the movable contact 376 and move it to the closed position thereof for closing the switch 375; an instant later the towel web 50 will also engage and close the movable contacts 342*a* and 343*a* of the switch 340, whereupon these movable contacts will be moved into engagement with the fixed contacts 342*c* and 343*c*. When thus closed, the switches 340 and 375 will permit energization of the solenoid 345 along a circuit including power line L3, conductor 346, coil 345*a*, conductor 349, switch contacts 343*a* and 343*c*, conductor 341 and the power line L2. The energization of the solenoid 345 will cause the valve 360 to be so conditioned as to shut off the cylinder air inlet 188 and the conduit 362 from the air supply and open the conduit 362 to the exhaust, while connecting the conduit 363 and the cylinder air inlet 189 to the source of air, thereby permitting the ejector arm 185 to return to the retracted position thereof. The valve 360 is preferably metered so that the ejector arm 185 is retracted at a controlled slow rate. When the ejector arm is thus retracted, the switch 357 will be opened, thus breaking the energizing circuit for the motor starting relay 355, but the relay 355 will be held energized through a holding circuit including conductor 356 and the contacts 342*a* and 342*c* of switch 340.**

The closing of the switches 340 and 375 also provides a circuit for energizing the solenoid 370, this circuit including power line L1, conductors 346 and 372, solenoid coil 371, conductor 374, switch 375, conductor 349, contacts **343*a* and 343*c* of switch 340, conductor 341 and power line L2. When the solenoid 370 is thus energized, the valve 175 will be opened against the bias of the spring 177 to permit suction through the mandrel 160 in the manner described above. When the leading end 52 of the towel web 50 approaches the mandrel 160, it will be captured by the action of the suction through the mandrel openings 165 to initiate the winding of the towel web 50 on the rotating mandrel 160. The initiation of this winding will cause the towel web 50 to move from the first feed path along the feed conveyor 105 to the second feed path as described above, thereby opening the switch 375. The openings of the switch 375 deenerizes the solenoid 370, thereby closing the valve 175 and cutting off the suction through the mandrel 160, since this suction is no longer needed once the winding of the towel has been initiated. The winding of the towel web 50 on the mandrel 160 will continue until the towel has been completely wound into a towel roll 55. When the trailing end of the towel web 50 passes from the feed conveyor 105, the switch 340 will be opened, thereby deenergizing the solenoid 345 and the relay 355. The deenergization of the relay 355 opens the contacts 354 thereof for deenergizing the drive motor 155, whereupon the mandrel 160 will come to a halt. The deenergization of the solenoid 345 so conditions the valve 360 that the air supply will be connected to the air inlet 188 of the cylinder 181 through the conduit 362 after a delay of about two seconds caused by the delay device 348 to permit the mandrel 160 to come to a halt. When the air source is thus connected to the cylinder 181 the ejector arm 185 will be moved to its ejecting position thereby removing the wound towel roll 55 from the mandrel 160 and depositing it in the receptacle 177. Movement of the ejector arm 185 to the ejecting position thereof will also close the switch 357 for thereby immediately re-energizing the starting relay 355 and restarting the drive motor 155. The ejector arm 185 will then remain in its ejecting position until the appearance of the next towel 50 in the associated feed lane of the feed conveyor 105.**

If for any reason the towel processing equipment feeding the automatic towel winding 100 has to be stopped, the interlock switch 320 will be opened, thereby opening the power line L1 and deenergizing the starting relay 355 in each of the winding units 350A to 350J. However, the circuit between the power lines L2 and L3 energizing the ejector solenoid 345 will not be opened, so that the ejectors 180 will not be actuated to eject partially wound towel rolls 55 when the processing equipment and drive motors are thus stopped. Thus, the drive motors 155 of the winding units may be stopped in mid-cycle to avoid damage thereto and may be started again to complete the cycle when the associated processing equipment is restarted.

Figure 23:
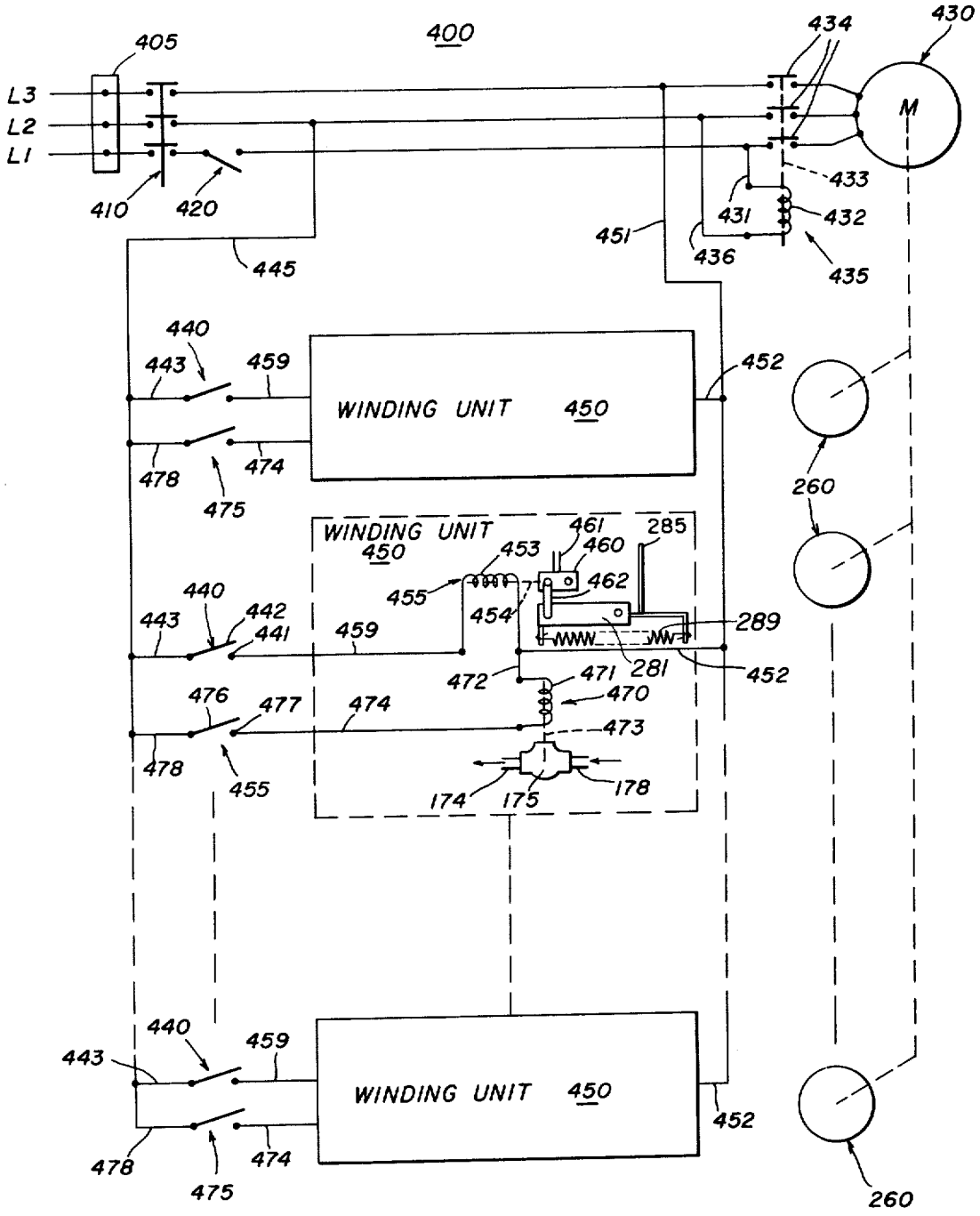
FIG. 23 is a schematic electric circuit diagram of the control apparatus for the towel winding machine of this invention for use with the line shaft and slip clutch drive arrangement of FIGS. 18 and 19.

Referring now to FIG. 23 of the drawings, there is shown a control apparatus 400 for the single drive motor embodiment of the winding machine illustrated in FIGS. 18 and 19 of the drawings. The single drive motor, generally designated by the numeral 430, is a three-phase motor and is driven from a suitable source of three-phase alternating current electrical power (not shown). Power lines L1, L2 and L3 from this source of three-phase electric power are fed through a terminal block 405 and a main circuit breaker 410 and, thence through the contacts 434 of a starting relay 435 to the terminals of the motor 430. There is also provided in the power line L1 between the circuit breaker 410 and the starting relay contact 434 a feed equipment interlock switch 420 which is identical in construction and operation to the feed equipment interlock switch 320 in the control apparatus 300. The starting relay 435 comprises a coil winding 432 and an armature 433 coupled to the contacts 434 for effecting movement thereof. One terminal of the coil winding 432 is connected by a conductor 431 to the power line L1, the other terminal of the coil winding 432 being connected by a conductor 436 to the power line L2. The contacts 434 of the starting relay 435 are normally open and are closed upon energization of the relay 435.

The control apparatus 400 includes a plurality of identical winding units 450, several of the winding units 450 being represented in block form in FIG. 23, with only one of these winding units being illustrated in detail. Each of the winding units 450 has associated therewith a control switch 440 and a control switch 475 mounted on the feed conveyor 105 and respectively corresponding to the control switches 340 and 375 in the control apparatus 300. The switch 440 is a single-pole, single-throw, siwtch having a fixed contact 441 and a movable contact 442, the movable contact 442 being connected by a conductor 443 to a conductor 445 which is in turn connected to the power line L2. Similarly, the switch 475 is of the single-pole, single-throw variety and includes a movable contact 476 and a fixed contact 477, the movable contact 476 being connected to the conductor 445 by a conductor 478. Thus, it can be seen that each of the switches 440 and 475 for all of the winding units 450 are connected in parallel to the conductor 445 and the power line L2. While the control circuit 400 is such that the switch 440 need be only of the single-pole, single-throw variety it would, of course, be possible to utilize the double-pole, double-throw switch 340 of the control apparatus 300 in place of the switch 440 by simply leaving one of the poles unconnected. In this way, the feed conveyor 105 could be used interchangeably with either type of drive arrangement without changing the control switches thereon. In any event, the movable contacts 442 and 476 of the switches 440 and 475 are physically of the same construction as the movable contacts 342*a* and 376 in the embodiment of FIG. 22, and are similarly disposed in their normally opened positions in the first feed path of the towel web 50 along the feed conveyor 105, and will function exactly the same as the contacts 342*a* and 376 in the embodiment of FIG. 22.

The winding unit 450 is provided with an ejector unit 280 of the type illustrated in FIG. 20 of the drawings, but it will, of course, be recognized that the ejector unit 180, illustrated in FIG. 3 of the drawings may also be used. Furthermore, the ejector unit 280 may be substituted for the ejector unit 180 in the arrangement of FIG. 22. The ejector unit 280 is controlled by a solenoid-actuated control valve 460 which is coupled by an inlet 461 to a suitable source of air (not shown). The control valve 460 is also coupled by a conduit 462 to the air inlet 288 of the cylinder 281. The valve 360 is controlled by a solenoid 455 which includes a coil winding 453 and an armature 454, the armature 454 being mechanically coupled to the valve 460. One terminal of the solenoid coil 453 is connected to the power line L3 by a conductor 451 and a conductor 452, the otheer terminal of the solenoid coil 454 being connected by a conductor 459 to the fixed contact 441 of the control switch 440. The solenoid 455 is so arranged that it is normally de-energized when there is no towel in the associated feed lane of the feed conveyor 105, the armature 454 then holding the valve 460 in such a condition that air passes through the conduit 462 into the cylinder 281 for holding the ejector arm 285 in the ejecting position thereof. When the solenoid 455 is energized, the armature 454 thereof changes the condition of the valve 460 so that the conduit 462 is disconnected from the source of air and is connected to an exhaust port, preferably having a controllable restriction or bleed opening, whereby air is exhausted from the cylinder 281 and the ejector arm 285 is moved to the retracted position thereof under the urging of the coil spring 289 at a controlled slow rate.

There is also provided a suction control valve solenoid 470 for controlling the operation of the suction valve 175. As was described above, the valve 175 is coupled by a connector 178 to the open end of the mandrel 160 and is coupled by a conduit 174 to the manifold provided in the cross beam 135 of the frame 130. The solenoid 470 comprises a coil winding 471 and an armature 473, one terminal of the coil 471 being connected by a conductor 472 to the conductor 452 and the other terminal of the coil 471 being connected by a conductor 474 to the fixed contact 477 of the control switch 475. The armature 473 is mechanically coupled to the valve 175, the solenoid 470 being so arranged that when it is energized the armature 473 will open the valve 175 thereby permitting passage of air therethrough, whereby the suction pump 170 will create a suction through the openings 165 in the mandrel 160 as described above. When the solenoid 470 is de-energized, a coil spring 177 (see FIG. 18) will return the armature 473 to close the valve 175 thereby isolating the mandrel 160 from the suction pump 170 and permitting the pressure in the mandrel 160 to return to atmospheric pressure for terminating the suction through the openings 165. As was explained above with respect to FIGS. 18 and 19, the drive motor 430 is mechanically coupled to the mandrel 160 of each of the winding units by means of a plurality of slip clutch assemblies 260, the slip clutch assemblies 260 being diagrammatically illustrated in FIG. 23.

The operation of one of the winding units 450 of the control apparatus 400 will now be described in detail. When there is no towel web 50 in the associated feed lane of the feed conveyor 105, the switches 440 and 475 will be in their normally open positions, whereby the starting relay 435 and the solenoids 455 and 470 are all de-energized. As is apparent from FIG. 23, the drive motor 430 will normally be operated continuously as long as the circuit breaker 410 and the feed equipment interlock switch 420 are closed. However, the winding unit 450 is designed to operate on a continuously repeating cycle as towels are repeatedly fed into the associated feed lane. When the leading end 52 of a towel web 50 is fed onto the feed conveyor 105 along the first path described above, it will engage the movable contact 476 of the control switch 475 and move it to the closed position thereof for closing the switch 475. When thus closed, the switch 475 will permit energization of the solenoid 470 along a circuit including power line L3, conductors 451, 452 and 472, coil 471, conductor 474, switch 475, conductors 478 and 445 and power line L2. The energization of solenoid 470 will cause the valve 175 to be opened against the bias of the spring 177 to permit suction through the mandrel 160 in the manner described above. An instant after closing the switch 475, the leading end 52 of the towel web 50 will engage the movable contact 442 and move it to the closed position thereof for closing the control switch 440. When thus closed, the switch 440 will permit energization of the solenoid 455 along a circuit including the power line L3, conductors 451 and 452, coil 453, conductor 459, switch 440, conductors 443 and 445 and power line L2. The energization of solenoid 455 will cause the valve 460 to be so conditioned as to shut off the cylinder air inlet 288 and the conduit 462 from the air supply and open the conduit 462 to the exhaust, thereby permitting the ejector arm 285 to return to the retracted position thereof at a controlled slow rate, the ejector arm 285 having been left in its ejecting position after ejection of the previous towel roll 55. When the leading end 52 of the towel web 50 approaches the mandrel 160, it will be captured by the action of the suction through the mandrel 160 to initiate the winding of the towel web 50 on the mandrel 160. The initiation of this winding will cause the towel web 50 to move from the first feed path along the conveyor 105 to the second feed path described above, thus opening the switch 475. This opening of the switch 475 de-energizes the solenoid 470, thereby allowing the valve 175 to close under the action of the spring 177 for cutting off the suction through the mandrel 160, since this suction is no longer needed once the winding of the towel has been initiated. The winding of the towel web 50 on the mandrel 160 will continue until the towel is completely wound into a towel roll 55. When the trailing end of the towel web 50 passes from the feed conveyor 105, the switch 440 will be opened thereby de-energizing the solenoid 455. The de-energization of the solenoid 455 so conditions the valve 460 that the air supply will be connected to the air inlet 288 of the cylinder 281 through the conduit 462 for moving the ejector arm 285 to its ejecting position, thereby removing the wound towel roll 55 from the mandrel 160 and depositing it in the receptacle 177. The ejector arm 285 will then remain in its ejecting position until the appearance of the next towel web 50 in the associated feed lane of the feed conveyor 105 for beginning the cycle anew.

As described above, the slip clutch assembly 260 operates to maintain a substantially constant torque at the mandrel 160, whereby as the weight and diameter of the towel roll 55 increases, the slippage in the clutch assembly 260 will cause the rotational speed of the mandrel 160 to be reduced for keeping the surface speed of the towel roll 55 substantially the same as the surface speed of the feed conveyor 105. This operation of the slip clutch assembly 260 generates a substantial amount of heat in the backing plate 274, the friction plate 275 and the clutch plate 276, which heat is dissipated by the cooling fins 277 as described above, in connection with FIG. 18. It will be noted that the drive motor 430 runs continuously during and between cycles of the winding units 450, thereby facilitating the coooling of the clutch assembly 260 by providing a period of unloaded free running between winding cycles for dissipating the heat generated during the previous winding cycle.

From the foregoing, it will be observed that there has been provided an automatic towel winding machine which is capable of automatically winding a plurality of elongated towels simultaneously. In particular, there has been provided an automatic towel winding machine which may be used in conjunction with an automatic towel ironer and which provides completely automatic operation from the time that the towels are fed to the ironer to the time that they are ejected as completely wound towel rolls from the towel winding machine.

There has also been provided a novel feed apparatus for the towel winding machine, the feed apparatus including a high-speed transfer conveyor to prevent folding of the towel webs as they are fed from the associated ironer and an inclined feed conveyor for transporting the towel webs from the transfer conveyor to a point immediately above the associated winding unit whereby the towel web may be fed downwardly by gravity to the associated winding unit.

There has also been provided an automatic winding unit having a suction-operated capture means for urging the leading end of the towel web fed from the feed apparatus against the winding mandrel and causing it to adhere thereto to obviate hand starting of the towel on the mandrel and thereby providing fully automatic towel winding.

There has also been provided a fluid-actuated ejector unit for automatically ejecting the wound towel roll from the mandrel into a towel receptacle, two different embodiments of the ejector having been provided for returning the ejector to a retracted position at a controlled slow rate.

There has also been provided a winding machine wherein a plurlality of towels are fed along a plurality of parallel feed lanes arranged in side-by-side relationship and each having a width only slightly greater than the width of the associated towel. In particular, there has been provided a towel winding machine wherein the winding units for each of the feed lanes has a width approximately three times the width of the associated feed lane, the winding units being uniquely arranged on a supporting frame so that the entire winding machine occupies a width only slightly greater than the combined widths of the feed lanes. In connection with this unique arrangement of the winding units, there has been provided guide apparatus for guiding each of the towel webs to its associated winding mandrels without interfering with the winding units of adjacent feed lanes.

There has also been provided a winding machine wherein the towel web is fed in the associated feed lane along a first path until the initiation of the winding of the towel on the mandrel is begun, at which time the towel web moves to a second feed path in the feed lane wherein the towel web is maintained under tension. In addition, there has been provided a novel feed-directing assembly for continuously maintaining the towel web in a predetermined direction toward the associated winding mandrel when the towel web is in the tensioned second feed path thereof.

There has also been provided a winding unit having a novel torque motor for effecting rotation of the winding mandrel and maintaining a substantially constant torque thereat, whereby as the diameter of the towel roll increases on the mandrel, the rotational speed of the mandrel will correspondingly decrease so that the surface speed of the towel roll will be maintained substantially the same as the surface speed of the feed apparatus.

There has also been provided an alternative drive arrangement for the winding machine wherein a single drive motor drives all of the winding units through a pair of line shafts, each of the line shafts being coupled to a plurality of the winding mandrels. In particular, there has been provided a single-motor drive arrangement which is coupled to each of the winding mandrels through a slip clutch for maintaining a substantially constant torque at the winding mandrel.

Finally, there has been provided for each of the embodiments of the drive means for the winding units an electric control circuit for effecting the completely automatic operation of the towel winding machine.

While there have been described what are at present considered to be the preferred embodiments of the invention, it will be understood that various modifications may be made therein and it is intended to cover in the appended claims all such modifications as fall within the true spirit and scope of the invention.

What is claimed is:

1. An elongated towel winder comprising a support frame, a mandrel mounted at one end thereof on said frame and rotatable about the longitudinal axis thereof for winding an associated elongated towel into a roll thereon, a constant-torque electric drive motor carried by said frame and coupled to said one end of said mandrel for effecting rotation thereof and maintaining a substantially constant torque thereat, feed apparatus mounted adjacent to said mandrel for feeding an elongated towel to said mandrel, the increasing weight of the towel roll on said mandrel as the diameter of the towel roll increases serving to decrease the rotational speed of said mandrel to maintain a substantially constant tension in the portion of the towel extending between said mandrel and said feed apparatus, and an ejector member carried by said frame adjacent to said mandrel and having an enclosed opening therein for receiving said mandrel therethrough, said ejector member being independently movable axially of said mandrel between a retracted position and an ejecting position, and drive means coupled to said ejector member for effecting said independent movement thereof between the retracted and ejecting positions thereof, movement of said ejector member from the retracted position to the ejecting position thereof causing said ejector member to engage the wound towel roll and remove the towel roll from said mandrel at the free end thereof, means interconnecting said motor and said mandrel such that said mandrel is operatively connected to said motor and continues to rotate during removal of the towel roll from said mandrel whereby an elongated towel may be fed to said rotating mandrel and wound in a roll thereon and removed therefrom when the roll is completely wound.

2. The towel winder set forth in claim 1, wherein said drive means comprises a fluid-actuated piston connected to said ejector member for moving said member to the ejecting position thereof, and means for returning said ejector member to said retracted position thereof at a controlled slow rate.

* * * * *